US006633733B2

(12) United States Patent
Mochimaru et al.

(10) Patent No.: US 6,633,733 B2
(45) Date of Patent: Oct. 14, 2003

(54) METHOD AND APPARATUS FOR PRINTING AN APPROPRIATE IMAGE EVEN ON A SPECIAL RECORDING MEDIUM

(75) Inventors: Hideaki Mochimaru, Kanagawa (JP); Yasukuni Omata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/983,964

(22) Filed: Oct. 26, 2001

(65) Prior Publication Data

US 2002/0051646 A1 May 2, 2002

(30) Foreign Application Priority Data

| | | |
|---|---|---|
| Oct. 27, 2000 | (JP) | 2000-328955 |
| Oct. 30, 2000 | (JP) | 2000-330567 |
| Oct. 1, 2001 | (JP) | 2001-305635 |
| Oct. 5, 2001 | (JP) | 2001-310057 |

(51) Int. Cl.[7] ..... G03G 15/00; G03G 15/16

(52) U.S. Cl. ..... 399/45; 399/302; 399/309; 399/405

(58) Field of Search ..... 399/45, 306, 66, 399/67, 69, 81, 391, 403, 405, 309, 302, 308

(56) References Cited

U.S. PATENT DOCUMENTS

| | | | |
|---|---|---|---|
| 3,724,944 A | 4/1973 | Sugita et al. | 355/18 |
| 3,765,760 A | 10/1973 | Mochimaru | 355/58 |
| 3,884,576 A | 5/1975 | Mochimaru et al. | 355/69 |
| 3,901,586 A | 8/1975 | Suzuki et al. | 359/726 |
| 4,056,320 A | 11/1977 | Mochimaru et al. | 355/75 |
| 4,105,326 A | 8/1978 | Mochimaru | 355/55 |
| 4,535,982 A | 8/1985 | Mochimaru | 271/127 |
| 4,605,299 A | 8/1986 | Mochimaru | 399/111 |

(List continued on next page.)

FOREIGN PATENT DOCUMENTS

| | | |
|---|---|---|
| JP | 1-209470 | 8/1989 |
| JP | 9-006066 | 1/1997 |
| JP | 10-142869 | 5/1998 |
| JP | 11-327352 | 11/1999 |
| JP | 2000-019799 | 1/2000 |
| JP | 2000-293065 | 10/2000 |

OTHER PUBLICATIONS

Patent Abstracts of Japan, JP 59–097168, Jun. 4, 1984.
Patent Abstracts of Japan, JP 10–097144, Apr. 14, 1998.
Patent Abstracts of Japan, JP 61–117582, Jun. 4, 1986.

*Primary Examiner*—Sophia S. Chen
(74) *Attorney, Agent, or Firm*—Oblon, Spivak, McClelland, Maier & Neustadt, P.C.

(57) ABSTRACT

An image forming apparatus that is capable of forming an appropriate image even on a special transfer sheet, such as a thick and rigid transfer sheet (e.g., a cardboard, an envelope, etc.), a long transfer sheet, etc. In the image forming apparatus, when the thick and rigid transfer sheet is used, a transfer bias applied to first and second transfer devices is increased by about 10% to 30% compared to that applied when a normal transfer sheet is used, and a temperature of fixing rollers is increased by about 10% to 30% compared to that when the normal transfer sheet is used. When the long transfer sheet that is longer than a circumferential length of a second image bearing member is used, an image transfer onto the second image bearing member is prohibited. In addition, the temperature of the fixing rollers is increased by about 10% to 30% compared to that when the normal transfer sheet is used.

88 Claims, 29 Drawing Sheets

U.S. PATENT DOCUMENTS

| | | | | | |
|---|---|---|---|---|---|
| 4,703,334 | A | | 10/1987 | Mochimaru et al. | 347/130 |
| 4,753,543 | A | | 6/1988 | Mochimaru et al. | 400/703 |
| 4,757,344 | A | | 7/1988 | Idenawa et al. | 399/113 |
| 4,875,063 | A | | 10/1989 | Idenawa et al. | 347/152 |
| 4,987,446 | A | | 1/1991 | Mochimaru et al. | 399/113 |
| 5,012,295 | A | * | 4/1991 | Ikkatai et al. | 399/405 X |
| 5,089,855 | A | | 2/1992 | Mochimaru | 399/297 |
| 5,204,716 | A | | 4/1993 | Kasahara et al. | 355/24 |
| 5,394,231 | A | | 2/1995 | Sudo et al. | 399/228 |
| 5,499,078 | A | | 3/1996 | Kurokawa et al. | 399/31 |
| 5,521,692 | A | * | 5/1996 | Bares | 347/221 |
| 5,559,590 | A | | 9/1996 | Arai et al. | 399/314 |
| 5,570,162 | A | | 10/1996 | Sohmiya | 399/174 |
| 5,594,540 | A | | 1/1997 | Higaya et al. | 399/326 |
| 5,615,872 | A | | 4/1997 | Mochimaru | 271/3.14 |
| 5,619,311 | A | | 4/1997 | Kurokawa et al. | 399/176 |
| 5,678,152 | A | | 10/1997 | Kohno et al. | 399/324 |
| 5,828,461 | A | * | 10/1998 | Kubo et al. | 399/45 X |
| 5,832,354 | A | | 11/1998 | Kouno et al. | 399/330 |
| 5,862,435 | A | * | 1/1999 | Suzumi et al. | 399/405 |
| 5,915,147 | A | | 6/1999 | Kouno et al. | 399/69 |
| 5,970,277 | A | * | 10/1999 | Shigeta et al. | 399/306 |
| 5,991,563 | A | | 11/1999 | Haneda et al. | 399/68 |
| 6,088,547 | A | * | 7/2000 | Martin et al. | 399/45 |
| 6,151,057 | A | | 11/2000 | Yamazaki et al. | 347/248 |
| 6,173,148 | B1 | | 1/2001 | Matsuda et al. | 399/310 |
| 6,347,214 | B1 | | 2/2002 | Kaneko | 399/397 |

* cited by examiner

METHOD AND APPARATUS FOR PRINTING AN APPROPRIATE IMAGE EVEN ON A SPECIAL RECORDING MEDIUM

BACKGROUND OF THE INVENTION

1. Field of the Invention

The present invention relates to a method and an apparatus for forming images on both surfaces of a recording medium, and more particularly to a method and an apparatus that can adjust an image forming condition when a special recording medium is used.

2. Discussion of the Background

An image forming apparatus, such as a copying machine, a printer, a facsimile, etc., can be configured such that an image is printed on both surfaces of a recording medium (hereinafter referred to as a transfer sheet). In a background image forming apparatus, a both-surfaces printing is generally performed in the following manner. Namely, an image formed on a surface of an image bearing member is transferred and fixed onto one surface of the transfer sheet. The transfer sheet having the image on one surface thereof is then reversed, for example by conveying the transfer sheet through a sheet reversing path. The reversed transfer sheet is conveyed again to an image transfer region so that another image is transferred and fixed onto the other surface of the transfer sheet.

It is a significant challenge to ensure reliability of a conveyance of the transfer sheet when the both-surfaces printing is performed in an image forming apparatus having the above-described system, because a switching of a conveying direction of the transfer sheet and a curl given to the transfer sheet while an image is fixed onto one surface of the transfer sheet are involved. Japanese Patent Laid-Open Publication Nos. 1-209470 and 10-142869 disclose a technology for performing a fixing operation of toner images, which are transferred onto both surfaces of the transfer sheet by first and second image bearing members, at one time.

According to the technology disclosed in Japanese Patent Laid-Open Publication No. 1-209470, a first image formed on a surface of a photoconductive element is transferred onto a transfer belt by a first transfer device. A second image formed on the surface of the photoconductive element is transferred onto one surface of the transfer sheet by the first transfer device. The first image transferred onto the transfer belt is then transferred onto the other surface of the transfer sheet by a second transfer device. Thus, images are transferred onto both surfaces of the transfer sheet, which are then fixed by a fixing device.

According to the technology disclosed in Japanese Patent Laid-Open Publication No. 10-142869, an image forming apparatus employs two transfer devices. The transfer sheet having color images on both surfaces thereof is conveyed to a fixing device by which the images are fixed at one time. In this apparatus, a spur having a plurality of protrusions on a circumferential surface thereof is provided as a guide member to guide the transfer sheet that has unfixed toner images on both surfaces thereof.

A side of a surface of the transfer sheet, onto which a corresponding image is transferred, is fixedly determined in the background apparatus (i.e., for example, it is determined that first page and second page images are always transferred onto the surface and underside of the transfer sheet, respectively). Therefore, an inconvenience may be caused in collating printed transfer sheets by page, depending on a manner in which the printed transfer sheet is discharged.

Japanese Patent Laid-Open Publication No. 2000-19799 discloses an image forming apparatus having a transfer sheet reverse unit to switch the manner in which the printed transfer sheet is discharged, namely, face down or up.

The switching of the transfer sheet discharging manner (i.e., face down or up) is accomplished using the transfer sheet reverse unit while the side of the surface of the transfer sheet, onto which the corresponding image is transferred, is fixedly determined.

The present inventors have recognized that when a thick and rigid transfer sheet, such as a cardboard, etc., is used, problems may arise if an image forming operation is performed in the same manner as when a normal transfer medium is used. Problems may include the transfer sheet becoming folded or jammed while being conveyed, or degradation in quality of a printed image due to an insufficient image concentration or a low level of fixing performance.

Further, the present inventors have recognized that when a long transfer sheet is used, problems may arise as to how to handle an image data that is longer than a circumferential length of an intermediate transfer belt. In addition, a fixing temperature is decreased while an image is fixed onto the long transfer sheet. A designation of a sheet feeding device and sheet discharging tray is required. An input of information that the long transfer sheet is used needs to be performed in a simple manner.

SUMMARY OF THE INVENTION

The present invention has been made in view of the above-mentioned and other problems and addresses the above-discussed and other problems.

The present invention advantageously provides a novel image forming apparatus and method wherein an appropriate image is printed even if a special transfer sheet, such as a thick and rigid transfer sheet, a long transfer sheet, etc. is used.

According to an example of the present invention, an image forming apparatus includes a first image bearing member configured to transfer a visible image onto a first surface of a recording medium, a second image bearing member configured to transfer a visible image that has been transferred from the first image bearing member onto a second surface of the recording medium such that visible images are transferred onto both surfaces of the recording medium, and a controller configured to control an image forming condition based on a property of the recording medium.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
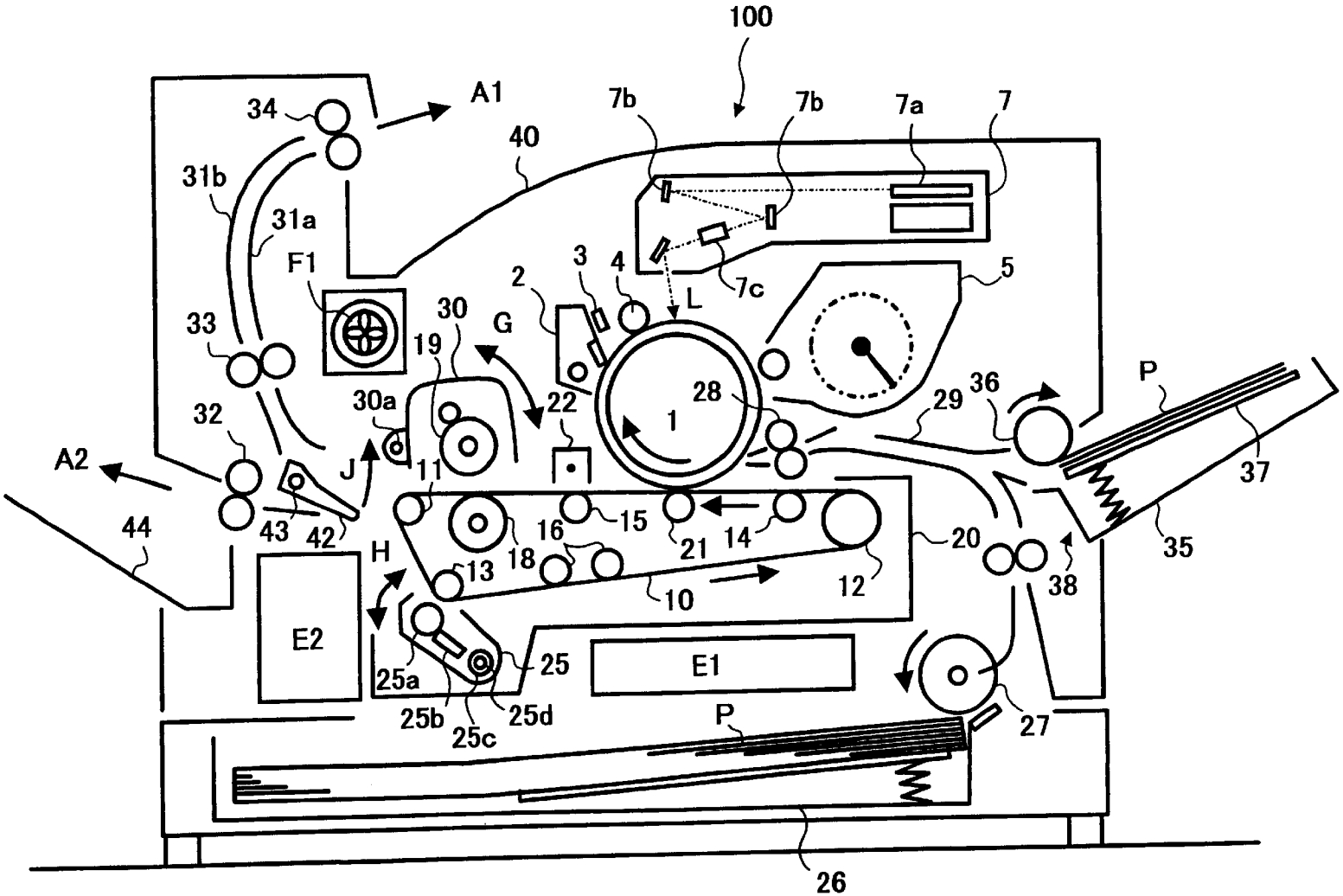
FIG. 1 is a schematic drawing illustrating a sectional view of a printer as an example of an image forming apparatus.

Referring now to the drawings, wherein like reference numerals designate identical or corresponding parts throughout the several views, an example of the present invention is described. FIG. 1 is a schematic drawing illustrating a sectional view of a printer as an example of an image forming apparatus.

A printer 100 shown in FIG. 1 includes a photoconductive drum 1, which is a first image bearing member, at the approximately center of the apparatus. A cleaning device 2, a discharging device 3, a charging device 4, and a developing device 5 are provided around the photoconductive drum 1. An exposure device 7 is arranged above the photoconductive drum 1. A surface of the photoconductive drum 1 is irradiated with a laser beam L emitted from the exposing device 7 at a writing position located between the charging device 4 and the developing device 5.

According to the example of the present invention, the photoconductive drum 1, the cleaning device 2, the discharging device 3, the charging device 4, and the developing device 5 are unitized as a process cartridge that can be replaced with a new one at the end of its useful life.

A belt unit 20 is provided below the photoconductive drum 1. The belt unit 20 includes an intermediate transfer belt 10 (i.e., second image bearing member) as a main component. The intermediate transfer belt 10 is provided such that it contacts a portion of the photoconductive drum 1. The intermediate transfer belt 10 is spanned around rollers 11, 12, and 13, and is moved in a counterclockwise direction. The intermediate transfer belt 10 has a heat-resistance and a resistance value that enables a transfer of toner.

Backing rollers 14 and 15, a cooling device 16, a fixing roller 18, and a first transfer device 21, etc., are provided inside the loop of the intermediate transfer belt 10. The fixing roller 18 includes a heat source, such as a heater inside the roller itself, and fixes a toner image transferred onto a transfer sheet. The first transfer device 21 is provided at a position opposed to the photoconductive drum 1 having the intermediate transfer belt 10 therebetween. The first transfer device 21 transfers a toner image formed on the surface of the photoconductive drum 1 onto the intermediate transfer belt 10 or the transfer sheet.

In the periphery of the intermediate transfer belt 10, a second transfer device 22, a fixing device 30, and a belt cleaning device 25 are arranged. The fixing device 30 includes a fixing roller 19 that has a heat source, such as a heater inside the roller itself, and fixes a toner image transferred onto the transfer sheet. The fixing device 30 is rotatably supported around a fulcrum 30*a*. The fixing device 30 is rotated in a direction indicated by an arrow "G" by a mechanism (not shown). The fixing device 30 is further configured such that it press-contacts with or separates from the fixing roller 18 having the intermediate transfer belt 10 (and a transfer sheet) therebetween. A fan F1 is employed left above the fixing device 30 to discharge the air in the housing of the apparatus to prevent an excessive rise of the temperature in the housing.

The belt cleaning device 25 includes a cleaning roller 25*a*, a blade 25*b*, and a toner transporting device 25*c* and scrapes residual toner remaining on the surface of the intermediate transfer belt 10. The toner accumulated in the belt cleaning device 25 is conveyed to a container (not shown) by the toner transporting device 25*c*. The belt cleaning device 25 is configured such that it rotates around a fulcrum 25*d* in a direction indicated by an arrow "H". The cleaning roller 25*a* is brought into contact with or separated from the intermediate transfer belt 10 by rotating the belt cleaning device 25 itself by a mechanism (not shown).

A sheet feeding cassette 26 is provided at a lower part of the main body of the apparatus. The sheet feeding cassette 26 is slid in the right direction in FIG. 1. A sheet feeding roller 27 is provided at a position above a tip end side of the sheet feeding cassette 26 in a sheet feeding direction (i.e., at the right side in FIG. 1). A pair of registration rollers 28 and a guide member 29 are provided on the right side of the photoconductive drum 1. The guide member 29 guides the transfer sheet P to an image transfer position. An electrical section E1 and a controlling device E2 are arranged above the sheet feeding cassette 26. A manual sheet feeding device 35 and a sheet feeding roller 36 are provided on the right side of the apparatus. The sheet feeding roller 36 feeds the transfer sheet P placed on a sheet stacking plate 37. The transfer sheet P fed from the manual sheet feeding device 35 is conveyed to the registration roller pair 28 while being guided by the guide member 29.

A switching pick 42 is provided on the left side of the fixing device 30. The switching pick 42 pivots about a fulcrum 43 and switches a direction of the transfer sheet P conveyed from the belt unit 20 to a sheet discharge tray 40 (which is formed in the top surface of the apparatus) or an exit tray 44 (which is provided to the side of the apparatus). The switching pick 42 is operated by an actuator, for example a solenoid and the like (not shown). When the switching pick 42 is moved to a position illustrated in FIG. 1, the transfer sheet P is conveyed to the sheet discharge tray 40. When the switching pick 42 is switched to a direction indicated by an arrow "J", the transfer sheet P is conveyed in direction A2 to the exit tray 44.

A pair of sheet conveying rollers 33 are provided above the switching pick 42 to convey the transfer sheet P. Above the pair of the sheet conveying rollers 33, a pair of sheet discharging rollers 34 are arranged to discharge the transfer sheet P to the sheet discharge tray 40. A transfer sheet conveying path between the pair of sheet conveying rollers 33 and the pair of sheet discharging rollers 34 is guided by guide members 31*a* and 31*b*. A pair of sheet discharging rollers 32 are provided on the left side of the switching pick 42 to discharge the transfer sheet P to the exit tray 44.

An image forming operation in the above-described image forming apparatus is described below. At first, an operation for printing images on both surfaces of a transfer sheet is explained. Hereinafter, images formed firstly and secondly are referred to as a first image and a second image, respectively. Surfaces of the transfer sheet onto which the first and second images are transferred are referred to as a first surface and a second surface of the transfer sheet, respectively.

An image forming apparatus according to an example of the present invention is a printer. Thus, a signal for writing is transmitted from a host machine, for example a computer HC (see FIG. 3). The exposure device 7 is activated by the transmitted image signal. A laser beam emitted from a laser light source (not shown) of the exposure device 7 is scanned by a polygon mirror 7*a* that is rotated by a motor. The surface of the photoconductive drum 1, which is uniformly charged by the charging device 4, is irradiated with the laser beam via a mirror 7*b* and a fθ lens 7*c*. Thus, an electrostatic latent image corresponding to writing information is formed on the surface of the photoconductive drum 1.

The electrostatic latent image formed on the surface of the photoconductive drum 1 is developed by the developing device 5. A visible image with toner is then formed on the surface of the photoconductive drum 1. The toner image formed on the surface of the photoconductive drum 1 is transferred onto the surface of the intermediate transfer belt 10, which moves in synchronization with the movement of the photoconductive drum 1, by the first transfer device 21 provided on the back side of the intermediate transfer belt 10 that is a second image bearing member.

Residual toner remaining on the surface of the photoconductive drum 1 is cleaned by the cleaning device 2 and a residual charge thereon is discharged by the discharging device 3 for the following image forming operation. The intermediate transfer belt 10 moves in a counterclockwise direction while bearing the transferred image (i.e., image to be transferred onto the first surface of the transfer sheet). At this time, the second transfer device 22, the fixing device 30, and the belt cleaning device 25 are controlled to be put into a non-operating state (i.e., the power to these devices is disconnected or these devices are separated from the intermediate transfer belt 10) so that the toner image is not disturbed.

When the intermediate transfer belt 10 is moved to a predetermined position, a toner image to be transferred onto another surface of the transfer sheet (i.e., second surface) is formed on the surface of the photoconductive drum 1 with the above-described steps. A feeding of the transfer sheet P is then started. The transfer sheet P placed at the uppermost of the stack of transfer sheets stacked in the sheet feeding cassette 26 or the manual sheet feeding device 35 is fed and conveyed to the pair of the registration rollers 28, when the sheet feeding roller 27 or 36 is rotated in a direction indicated by an arrow.

The intermediate transfer belt 10 moves in synchronization with the movement of the photoconductive drum 1. The toner image (i.e., first image) previously transferred onto the intermediate transfer belt 10 is conveyed to a position where the intermediate transfer belt 10 contacts the photoconductive drum 1 after the toner image travels around the loop of the intermediate transfer belt 10 while being borne by the intermediate transfer belt 10.

The toner image formed on the surface of the photoconductive drum 1 is transferred onto the transfer sheet P (i.e., onto the second surface thereof) by the first transfer device 21. The transfer sheet P is conveyed to a nip formed between the photoconductive drum 1 and the intermediate transfer belt 10 via the pair of registration rollers 28. The pair of registration rollers 28 adjusts the time to feed the transfer sheet P to a transfer position of the second image such that the transfer sheet P is in register with the second image. The transfer sheet P is also in register with the first image.

According to the example of the present invention, the first transfer device 21, which is provided at a position opposed to the photoconductive drum 1 (i.e., first image bearing member), is configured to be a transfer roller type that is press-contacted with the underside of the intermediate transfer belt 10 (i.e., second image bearing member). Thus, the photoconductive drum 1 and the transfer sheet P are kept in intimate contact with each other, resulting in a fine transferability of a toner image.

While the toner image (i.e., second image) is transferred onto the surface of the transfer sheet P from the photoconductive drum 1, the other surface of the transfer sheet P moves together with the toner image transferred onto the intermediate transfer belt 10 (i.e., the transfer sheet P moves while the first surface thereof intimately contacts the first image transferred onto the intermediate transfer belt 10). A voltage is applied to the second transfer device 22 to transfer the toner image, which has been transferred onto the intermediate transfer belt 10, onto the transfer sheet P when the transfer sheet P passes through the transfer region of the second transfer device 22.

The transfer sheet P having toner images transferred onto both surfaces thereof is conveyed to a fixing device 30 with the movement of the intermediate transfer belt 10. The fixing device 30 is rotated such that the fixing roller 19 is brought into press-contact with the fixing roller 18 while sandwiching the intermediate transfer belt 10 therebetween. Thus, the toner images on both surfaces of the transfer sheet P are fixed at one time by the fixing rollers 18 and 19. According to the construction of the image forming apparatus illustrated in FIG. 1, the intermediate transfer belt 10 is extended to the fixing region. Thus, the toner images are not disturbed, thereby preventing an occurrence of image degeneration, because the images are fixed while keeping the transfer sheet P in contact with the intermediate transfer belt 10 without separating the transfer sheet P from the intermediate transfer belt 10 after the toner images are transferred onto the transfer sheet P.

The transfer sheet P is separated from the intermediate transfer belt 10 at a curvature of a roller 11 after the toner images are fixed. The switching pick 42 switches a conveying direction of the transfer sheet P to the sheet discharge tray 40 or to the exit tray 44.

When the transfer sheet P is discharged to the sheet discharge tray 40, the transfer sheet P is stacked with the second surface thereof down (i.e., the surface of the transfer sheet P on which the image from the photoconductive drum 1 is transferred is placed down). Therefore, an image to be printed on page 2 of the transfer sheet P is firstly formed, which is then retained on the intermediate transfer belt 10 in the form of a toner image. An image to be printed on page 1 of the transfer sheet P is then formed, which is transferred directly onto the transfer sheet P from the photoconductive drum 1. Thus, the printed transfer sheets P are collated by page. Hence, the transfer sheet P discharged to the sheet discharge tray 40 (i.e., the transfer sheet P is discharged with face down) has a first image on page 2 of the transfer sheet P and a second image on page 1 of the transfer sheet P. A process similar to that described above is performed for images to be printed on and after page 3 of the transfer sheet P. When there is an image to be printed on an even-numbered page of the transfer sheet P, the image to be printed on the even-numbered page is firstly formed, which is transferred and retained on the intermediate transfer belt 10. Then, an image to be printed on the odd-numbered page that precedes the even-numbered page is then formed on the surface of the photoconductive drum 1, which is transferred directly onto the transfer sheet P. The image forming order of images printed on the pages of the transfer sheets P is: page 2→1→4→3→6→5 . . . .

When the transfer sheet P is discharged to the exit tray 44, the transfer sheet P is stacked with the second surface thereof up (i.e., the surface of the transfer sheet P on which an image from the photoconductive drum 1 is directly transferred is placed up). Thus, when the transfer sheet P is discharged to the exit tray 44 (i.e., the transfer sheet P is discharged with face up), a first image and a second image are printed on pages 1 and 2 of the transfer sheet P, respectively. A process similar to that as described above is performed for images to be printed on and after page 3 of the transfer sheet P. When there is an image to be printed on an odd-numbered page, the image to be printed on the odd-numbered page is firstly formed, which is transferred and retained on the intermediate transfer belt 10. Then, an image to be printed on the even-numbered page that follows the odd-numbered page is formed on the surface of the photoconductive drum 1, which is transferred directly onto the transfer sheet P. The image forming order of images printed on the pages of the transfer sheet P is: page 1→2→3→4→5→6 . . . .

A change in an image forming order to collate the printed transfer sheets P by page can be accomplished by a commonly known technology for storing image forming data in a memory.

According to the example of the present invention, when the transfer sheet P is fed from the manual sheet feeding device 35 and is discharged to the exit tray 44, the transfer sheet P is conveyed approximately straight without being flipped-over. Therefore, when an image is printed on a transfer sheet that has a large return force caused by a resilience of a slack in the transfer medium (i.e., a thick and rigid transfer sheet), such as a cardboard, an OHP film, and the like, a both-surfaces printing while collating the printed transfer media by page can be performed by feeding the transfer sheet using the manual sheet feeding device 35 and designating the exit tray 44 where the printed transfer media are discharged.

When a normal transfer sheet is used, the transfer sheet can be fed either by the sheet feeding cassette 26 or manual sheet feeding device 35, and either the sheet discharge tray 40 or the exit tray 44 can be designated. In this case, a both-surfaces printing while collating the printed transfer sheets by page can be performed. The operation, in which the transfer sheet is fed by the sheet feeding cassette 26 and the transfer sheet is discharged to the sheet discharge tray 40, may be set as a default setting for the transfer sheet that is most frequently used.

Generally, a reverse image (i.e., mirror image) is formed on the surface of the photoconductive drum 1. A normal image is then obtained when the reverse image is directly transferred onto the transfer sheet. When an image transferred onto the intermediate transfer belt 10 is transferred onto the transfer sheet, a reverse image is transferred onto the transfer sheet if the reverse image is formed on the surface of the photoconductive drum 1. Thus, according to the example of the present invention, the surface of the photoconductive drum 1 is exposed so as to form a normal image on the surface thereof when the image is transferred onto the transfer sheet from the intermediate transfer belt 10 (i.e., first image). To the contrary, a reverse image is formed on the surface of the photoconductive drum 1 for the image that is directly transferred onto the transfer sheet from the photoconductive drum 1 (i.e., second image). Switching an exposure to form reverse or normal images can be accomplished by a commonly known image processing technology.

The belt cleaning device 25, which is separated from the intermediate transfer belt 10, is rotated such that the cleaning roller 25*a* contacts the intermediate transfer belt 10 after the image on the intermediate transfer belt 10 is transferred onto the transfer sheet. Residual toner remaining on the surface of the intermediate transfer belt 10 is transferred to the surface of the cleaning roller 25*a* that is then scraped by the blade 25*b*. The scraped toner is conveyed to a container (not shown) by the toner transporting device 25*c*. Because the residual toner heated by the fixing rollers 18 and 19 is easily transferred to the cleaning roller 25*a* before it is cooled, it is preferable that the intermediate transfer belt 10 is cleaned at a position at an upstream side of the cooling device 16.

The intermediate transfer belt 10, which has passed the above-described cleaning region, is cooled by the cooling device 16. Various heat radiation systems may be adopted as the cooling device 16. When a system in which air is circulated is adopted, it is preferable that air is circulated after an image on the intermediate transfer belt 10 is transferred onto a transfer sheet so that the image retained on the surface of the intermediate transfer belt 10 is not disturbed. Further, a cooling device in which heat of the intermediate transfer belt 10 is absorbed using a heat pipe that directly contacts the inner surface of the intermediate transfer belt 10 may be adopted.

Next, an operation for printing an image on one-surface of a transfer sheet is explained below. The explanation is given in a case where a printed transfer sheet is discharged to the sheet discharge tray 40 and in a case where the printed transfer sheet is discharged to the exit tray 44.

First, an operation for printing an image on one-surface of the transfer sheet and discharging the printed transfer sheet to the sheet discharge tray 40 is explained. In this operation, a process to transfer a toner image onto the intermediate transfer belt 10 can be eliminated. In the one-surface printing operation, the toner image formed on the surface of the photoconductive drum 1 is directly transferred onto the transfer sheet. The toner image formed on the surface of the photoconductive drum 1 is a reverse image that becomes a normal image when it is transferred onto the transfer sheet.

Referring to FIG. 1, the transfer sheet P is conveyed to a nip formed between the photoconductive drum 1 and the intermediate transfer belt 10 in precise register with a toner image formed on the surface of the photoconductive drum 1. The toner image formed on the surface of the photoconductive drum 1 is transferred onto the transfer sheet P (i.e., on the surface of the transfer sheet P, which is on the side of the photoconductive drum 1) by the first transfer device 21.

The transfer sheet P is then conveyed by the intermediate transfer belt 10 to the fixing device 30 by which the toner image is fixed. In this case, the second transfer device 22 is not activated. The transfer sheet P is separated from the intermediate transfer belt 10 and is discharged to a direction indicated by an arrow "A1" via the guide members 31*a* and 31*b* and the pair of sheet discharging rollers 32. The discharged transfer sheet P is stacked in the sheet discharge tray 40 with the surface thereof having the image down (i.e., face down). With this configuration, the printed transfer sheets P stacked in the sheet discharge tray 40 are collated by page even when a document having a plurality of pages is processed in order of pages. The image forming order of images printed on the pages of the transfer sheets P is: page 1→2→3→4→5→6 . . . .

Next, an operation for printing an image on one-surface of the transfer sheet and discharging the printed transfer sheet to the exit tray 44 is explained. In this operation, a toner image formed on the surface of the photoconductive drum 1 is transferred onto the intermediate transfer belt 10 by the first transfer device 21. The intermediate transfer belt 10 rotates one time while bearing the toner image. The transfer sheet P is conveyed to the nip formed between the photoconductive drum 1 and the intermediate transfer belt 10 in precise register with the toner image on the intermediate transfer belt 10. The toner image on the intermediate transfer belt 10 is then transferred onto the transfer sheet P (i.e., on the underside surface of the transfer sheet P, namely the surface of the transfer sheet P on the side of the intermediate transfer belt 10) by the second transfer device 22. With this configuration, the printed transfer sheets P stacked in the exit tray 44 are collated by page even when a document having a plurality of pages is processed in order of pages. The image forming order of images printed on the pages of the transfer sheets P is: page 1→2→3→4→5→6 . . . .

When an image is printed on one-surface of the transfer sheet P, the image is formed with the same image forming order (i.e., page 1→2→3→4→) when the printed transfer sheet P is discharged to both the sheet discharge tray 40 and the exit tray 44. However, the image is printed on the different surface of the transfer sheet P when the printed transfer sheet P is discharged to the sheet discharge tray 40 and the exit tray 44. That is, the image is transferred onto the upper surface of the transfer sheet P (i.e., the surface of the transfer sheet P on the side of the photoconductive drum 1) from the photoconductive drum 1 when the printed transfer sheet P is discharged to the sheet discharge tray 40. To the contrary, the image is transferred onto the under surface of the transfer sheet P (i.e., the surface of the transfer sheet P on the side of the intermediate transfer belt 10) from the intermediate transfer belt 10 when the printed transfer sheet P is discharged to the exit tray 44.

When a transfer sheet that has a large return force caused by a resilience of a slack in the transfer medium (i.e., a thick and rigid transfer sheet), such as a cardboard, an OHP film, and the like, is used, one surface printing is performed while collating a printed transfer media by page by feeding the transfer sheet using the manual sheet feeding device 35 and designating the exit tray 44 where the printed transfer media are discharged.

When a cardboard or an envelope (that has a portion where a sheet is folded into two) is used as a transfer sheet, an image degeneration, such as a thin spot or an insufficient concentration of an image caused by a faulty transfer of the image, may occur irrespective of one-surface or both-surfaces printing operations. Thus, according to the example of the present invention, when a thick and rigid transfer sheet, such as a cardboard, an envelope, or the like, is used, a transfer current (i.e., an output of a transfer bias applied to the first transfer device 21 and the second transfer device 22) is increased by about 10% to 30% compared to the transfer bias applied when a normal transfer sheet is used.

Further, a sufficiently high fixing temperature may not be secured when a cardboard or an envelope is used as a transfer sheet if the fixing temperature is maintained at the same level as that for the normal transfer sheet. Thus, according to the example of the present invention, when the thick and rigid transfer sheet, such as the cardboard or envelope, is used, a temperature of the fixing rollers 18 and 19 is increased by about 10% to 30% compared to the temperature of these rollers when the normal transfer sheet is used.

An arbitrary transfer sheet other than the cardboard and envelope can be set as the thick and rigid transfer sheet for which an increased transfer current and fixing temperature are required compared to those required when the normal transfer sheet is used. For example, a sheet having a less smooth surface (i.e., having projections and depressions on its surface) or a lug sheet in which a fiber is mixed may be set as the thick and rigid transfer sheet.

In addition, a high level of fixing performance can be attained when the temperature of each fixing roller is individually controlled for one-surface and both-surfaces printing operations.

In one specific example, the temperature of the fixing rollers 18 and 19 may be set at (1) 160° C. to 180° C. for the fixing roller 19 while the fixing roller 18 is not heated when the one-surface printing (i.e., an image is directly transferred onto a transfer sheet from the photoconductive drum 1) is performed, and at (2) 160° C. to 180° C. for the fixing roller 19 while 180° C. to 190° C. for the fixing roller 18 when the both-surfaces printing is performed. The reason why the temperature of the fixing roller 18, which is provided inside the loop of the intermediate transfer belt 10, is higher than that of the fixing roller 19 when the both-surfaces printing is performed is that the fixing roller 18 heats the transfer sheet via the intermediate transfer belt 10. In addition, the temperature of the fixing roller 19 may be lowered in the both-surfaces printing compared to that when the one-surface printing is performed because of the effect of heat of the fixing roller 18. In any case, the above-described temperatures of each fixing device are only non-limiting examples. The temperature of each fixing device is to be set at an appropriate value considering various conditions, such as a characteristic of toner to be used, a material and thickness of the intermediate transfer belt 10, etc.

A temperature detecting device (not shown) may be provided to the fixing rollers 18 and 19 such that a heater of each fixing roller 18 and 19 is controlled based on a detection result of the temperature detecting device. For example, the heater may be controlled so that it generates less heat when the temperature detecting device detects that the temperature is excessively high.

Figure 2:
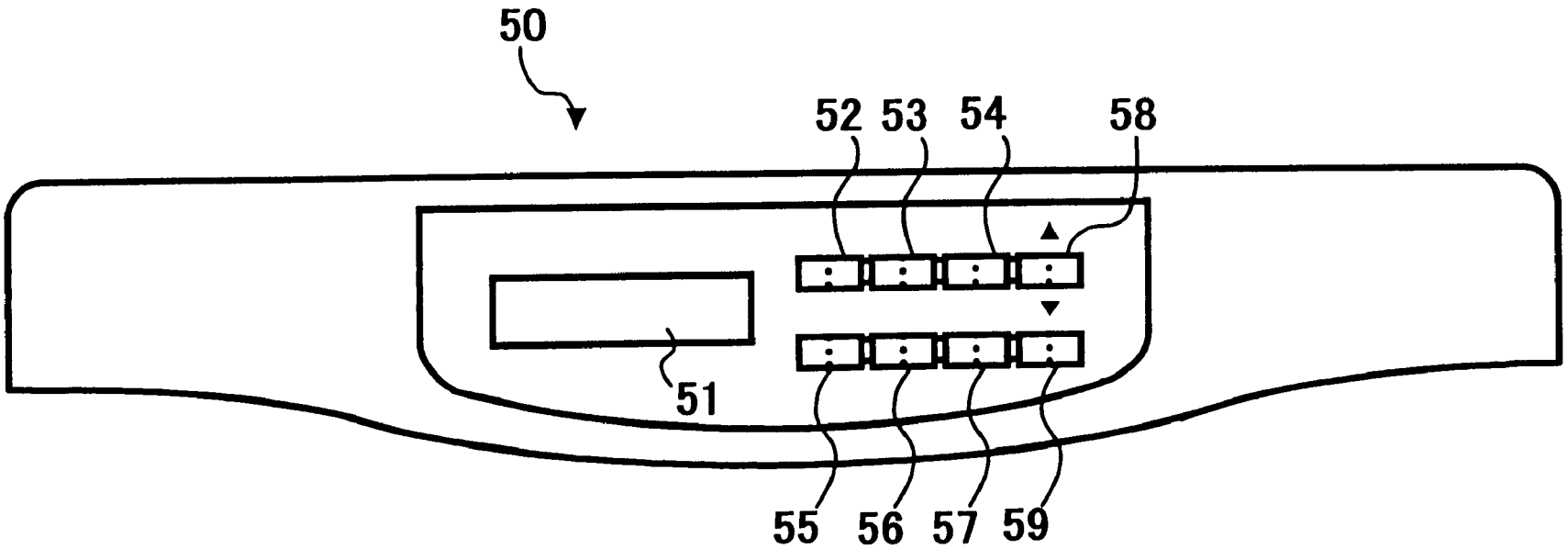
FIG. 2 is a drawing illustrating a top view of an operation panel of the printer.

FIG. 2 is a drawing illustrating a top view of the operation panel of the printer 100. As shown in FIG. 2, an operation panel 50 includes a LCD (Liquid Crystal Display) 51 and various setting buttons 52–59. An on-line button 52 is provided as an input key for switching the on-line and off-line of the printer 100. A reset button 53 is provided as an input key for resetting all of the previous settings. A sheet feeding button 54 is provided as an input key for designating (i.e., selecting) a type of a transfer sheet to be used. When a thick and rigid transfer sheet, such as a cardboard, an envelope, etc., is used, the thick and rigid transfer sheet is designated by depressing the sheet feeding button 54. A both-surfaces printing button 55 is provided as an input key for designating a both-surfaces printing. A setting button 56 is provided as an input key for making various settings. When the setting button 56 is depressed, items to be set are displayed on the LCD 51. A desired setting item can be selected by using a key labeled with an arrow in the direction of upward 58 or that labeled with an arrow in the direction of downward 59. The selection (i.e., designation) of the setting item is completed when a start button 57 is depressed. The setting item set by the setting button 56 includes a selection of a sheet feeding device, a sheet discharging tray, and a sheet discharge with pages collated and so forth. It can be configured such that the thick and rigid transfer sheet is automatically selected when the manual sheet feeding device 35 is designated as the sheet feeding device.

According to the example of the present invention, when a both-surfaces printing is performed, a both-surfaces printing mode is selected by depressing the both-surfaces printing button 55. When the setting button 56 is depressed, the sheet feeding device is selected, namely the sheet feeding cassette 26 or the manual sheet feeding device 35. Further, a sheet discharging tray is selected by depressing the setting button 56, namely the sheet discharge tray 40 or the exit tray 44. The selection of the setting can be made in combination with the selection of the sheet feeding device and the sheet discharging tray. In addition, discharging the printed sheets with pages collated can be selected in combination with the above-described selection. The selection of the setting in combination with the sheet feeding device, the sheet discharging tray, and the discharging of the printed sheets with pages collated can also be made when the one-surface printing is performed.

According to the example of the present invention, when the selection of the sheet feeding device, the sheet discharging tray, and the discharging of the printed sheets with pages collated is made, the order in which an image is formed and an image transfer process are appropriately controlled. Thus, the sheet feeding device, the sheet discharging tray, and whether or not the printed sheets are discharged with pages collated are automatically selected according to the designation of a user.

Figure 3:
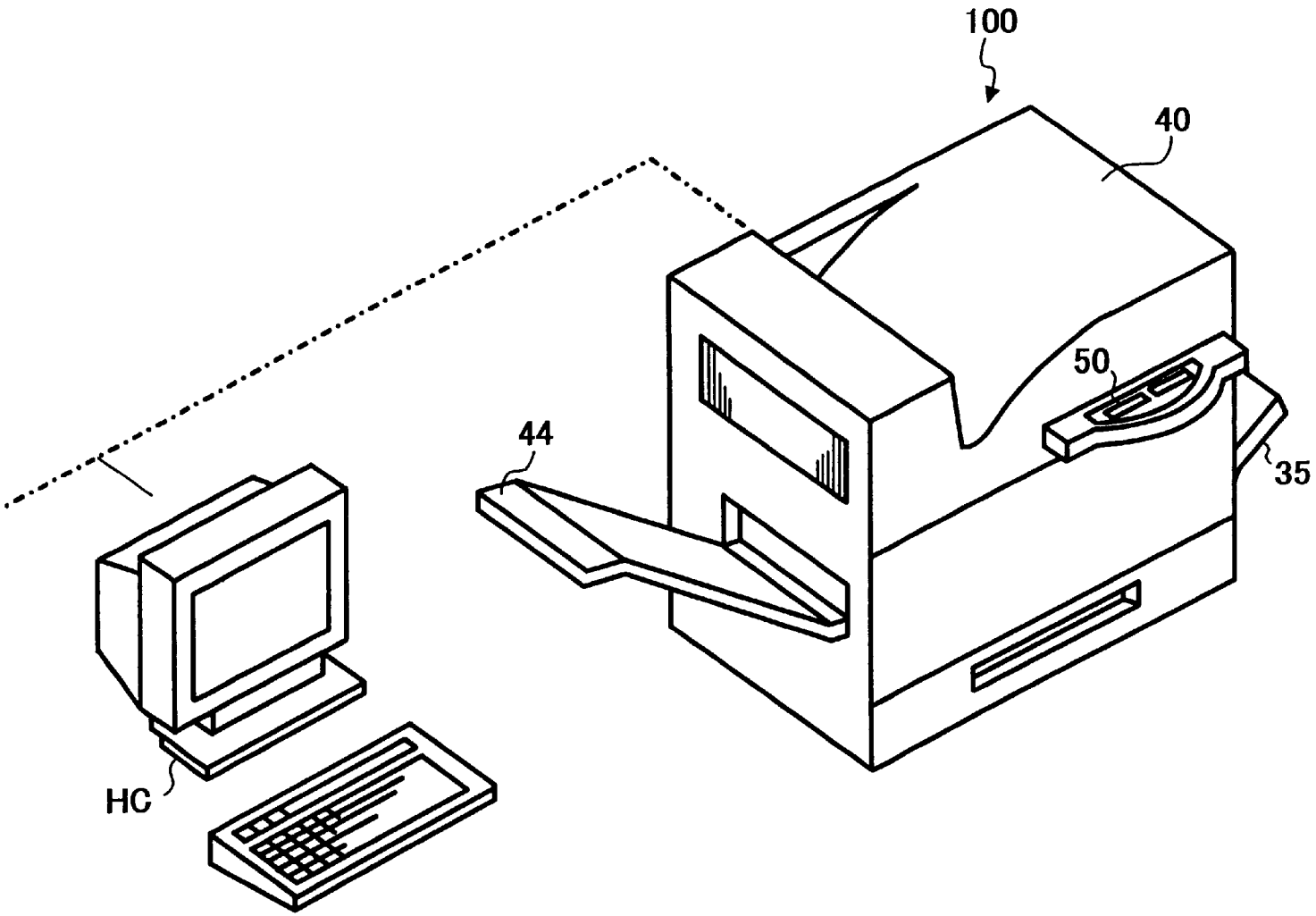
FIG. 3 is a perspective view illustrating the printer connected to a host computer.

FIG. 3 is a perspective view illustrating the printer 100 connected to a host computer HC (i.e., personal computer) via a network. The printer 100 can be connected to a plurality of host computers HC. The printer 100 may be connected to the host computers HC wirelessly. In such a system, various similar settings made via the operation panel 50 of the printer 100 can be made via the host computer HC. Therefore, an operator of the host computer HC can set the sheet feeding device, sheet discharging tray, a type of a transfer sheet, etc., in a place remote from the printer 100. When these settings are made, image forming and transfer operations are automatically performed so as to produce the image on one-surface or both-surfaces of the transfer sheet and discharge them with pages collated to any of the sheet discharging trays.

A property of a used transfer sheet can be input via the operation panel 50 or the host computer HC. In addition, a switch to select the type of the transfer sheet may be provided to the sheet feeding cassette 26 of the printer 100 (see FIG. 1) such that the switch corresponding to the set type of the transfer sheet is selected. Further, exclusive trays (or cassettes) for an envelope and a post card may be prepared such that the characteristic of the transfer sheet is input when the exclusive tray (or cassette) is set to the printer 100. A sensor 38 (see FIG. 1) to detect an opening of the manual sheet feeding device 35 may be provided such that the printer 100 determines that the thick and rigid transfer sheet is used when the sensor is turned on.

Figure 4:
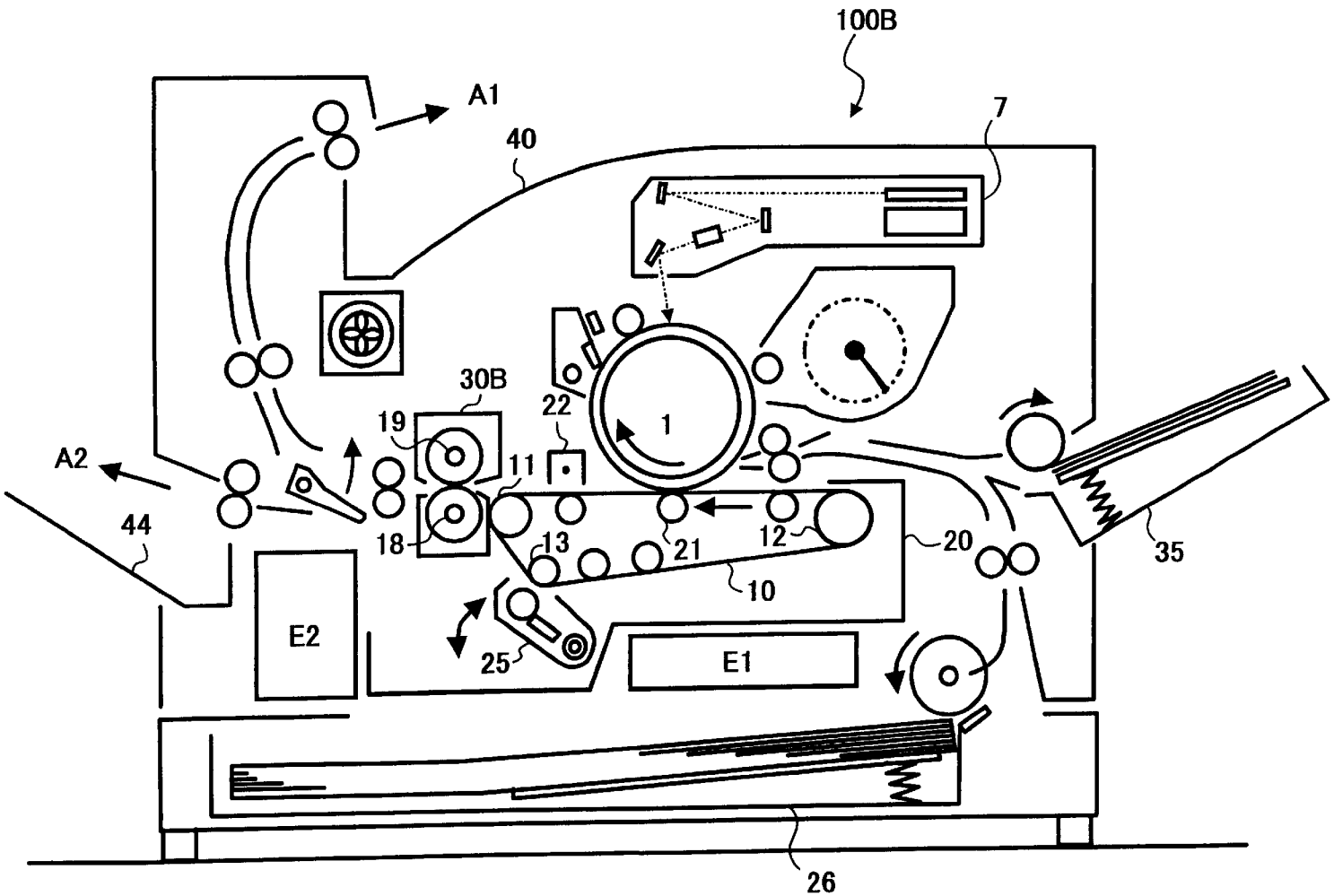
FIG. 4 is a schematic drawing illustrating another example of a printer having another type of fixing device.

FIG. 4 is a schematic drawing illustrating another example of a printer 100B having a fixing device 30B that is constructed differently from that of the printer 100. According to this example, the fixing device 30B is provided outside the loop of the intermediate transfer belt 10. The fixing device 30B includes two fixing rollers 18 and 19, each of which includes a heater inside. Regardless if a toner image is transferred on the intermediate transfer belt 10 or not, these two rollers 18 and 19 are kept in press-contact with each other. The fixing device 30B is fixedly provided, and thereby no mechanism is required to contact or separate the fixing device 30B with/from the intermediate transfer belt 10. The printer 100B is constructed similar to the printer 100 in FIG. 1 in aspects other than the fixing device.

Figure 5A:
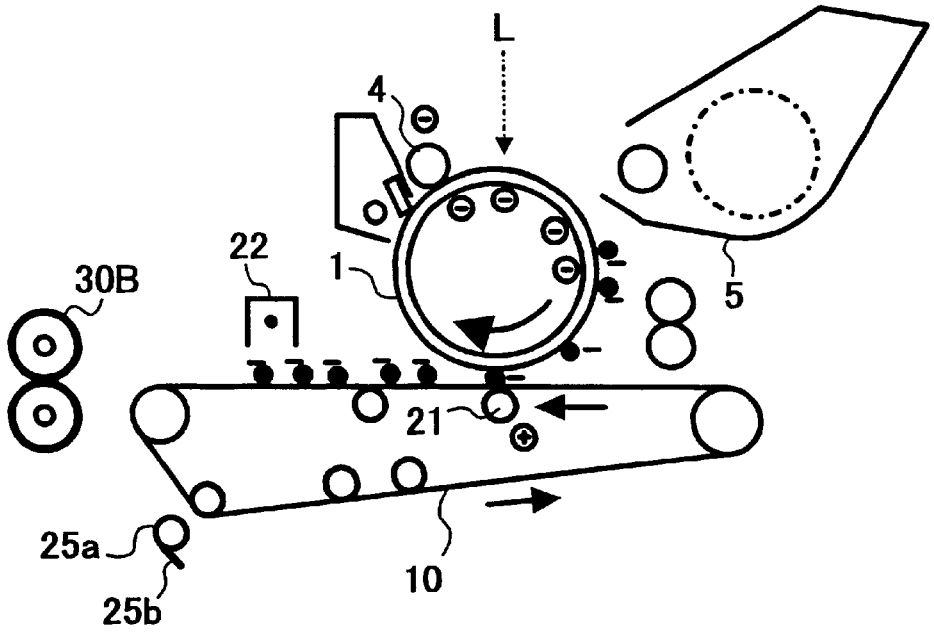
FIGS. 5A–5D are drawings illustrating an image forming process when a both-surfaces printing is performed in the printer illustrated in FIG. 4.
Figure 5B:
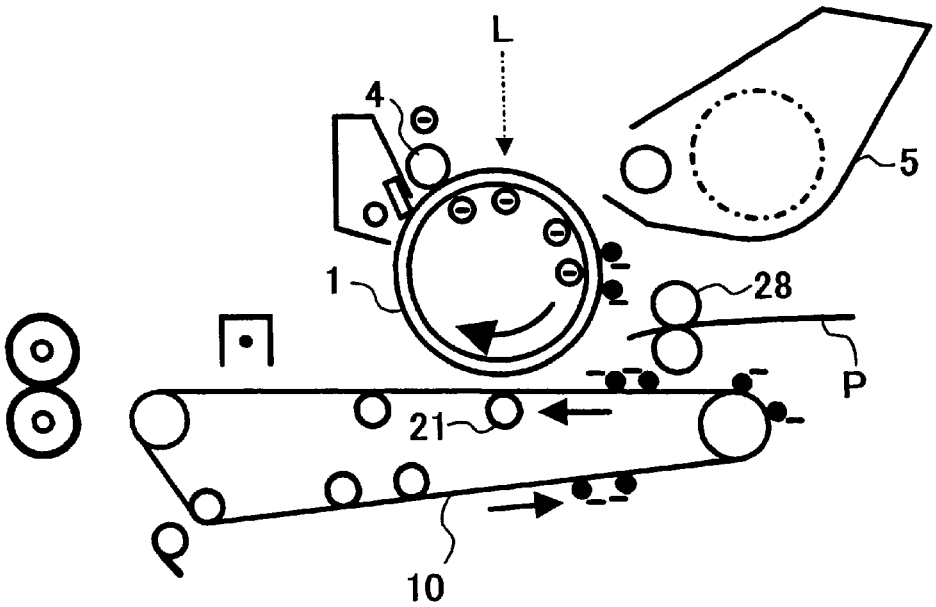
Figure 5C:
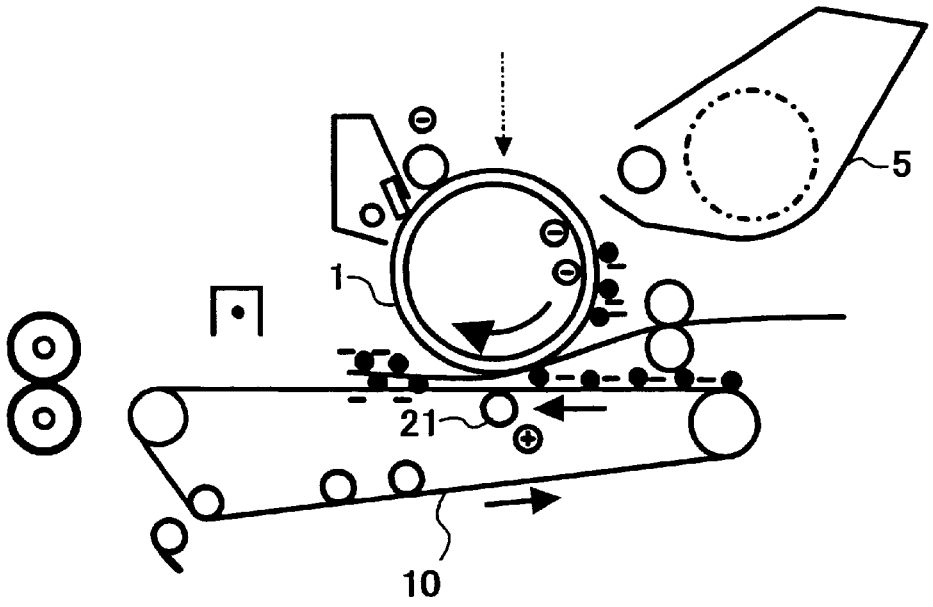
Figure 5D:
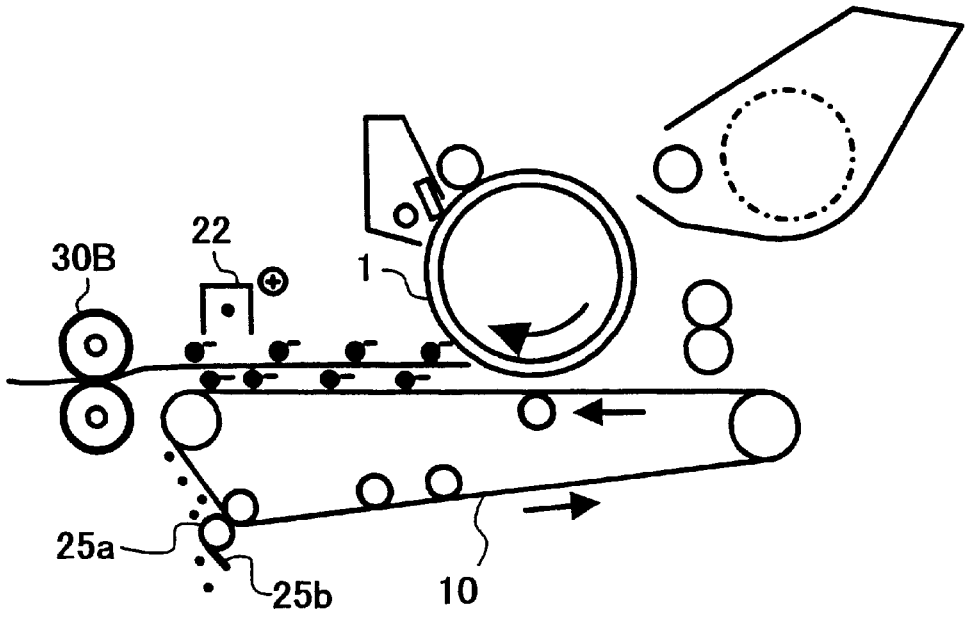

FIGS. 5A–5D show an image forming process when a both-surfaces printing is performed in the printer 100B. FIG. 5A shows a development and a first transfer operation. FIG. 5B shows a second development operation (i.e., development of an image printed on the second surface of the transfer sheet P). FIG. 5C shows a second transfer operation, and FIG. 5D shows a third transfer, a fixing, and a belt cleaning operation. In FIGS. 5A–5D, the transfer belt 10 is illustrated to be separated from the photoconductive drum 1 for convenience' sake, however, these are actually in contact with each other.

FIG. 5A shows a process in which (1) the photoconductive drum 1 is negatively charged (–) by the charging device 4, (2) negatively charged (–) toner (indicated by a black circle) is supplied from the developing device 5 to an electrostatic latent image formed by the laser beam L emitted from the exposing device 7, and (3) the toner image is transferred onto the intermediate transfer belt 10 with a positive (+) voltage applied by the first transfer device 21.

FIG. 5B shows a process in which (1) a negatively charged (–) toner image to be printed on the second surface of the transfer sheet P is formed on the surface of the photoconductive drum 1, and (2) the transfer sheet P is conveyed to a transfer position by the pair of registration rollers 28 by adjusting the time so as to be in precise register with the toner image formed on the surface of the photoconductive drum 1 and the toner image carried and conveyed by the intermediate transfer belt 10.

In FIG. 5C, the negatively charged second image formed on the surface of the photoconductive drum 1 is transferred onto the transfer sheet P with the positive voltage (+) applied by the first transfer device 21 (i.e., second transfer operation). At this time, the first surface of the transfer sheet P is in register with the first image carried on the intermediate transfer belt 10. According to the example of the present invention, a belt of middle resistance is used as the intermediate transfer belt 10 (i.e., second image bearing member). Thus, the transfer sheet P is retained on the surface of the intermediate transfer belt 10 with a natural charge opposing a charge of the transfer sheet P without applying a bias.

FIG. 5D shows a process in which (1) the negatively charged (–) first image carried on the intermediate transfer belt 10 is transferred onto the transfer sheet P with the positive voltage (+) applied by the second transfer device 22 (i.e., third transfer operation), (2) the transfer sheet P is conveyed to a transfer region where the toner images on both surfaces of the transfer sheet P are fixed by heat of the fixing device 30B, the transfer sheet P is smoothly conveyed to the fixing device 30B without disturbing the toner image on the transfer sheet P because the intermediate transfer belt 10 is extended close to the fixing device 30B, and (3) the cleaning roller 25*a* contacts the intermediate transfer belt 10 to remove residual toner remaining on the surface thereof.

Figure 6:
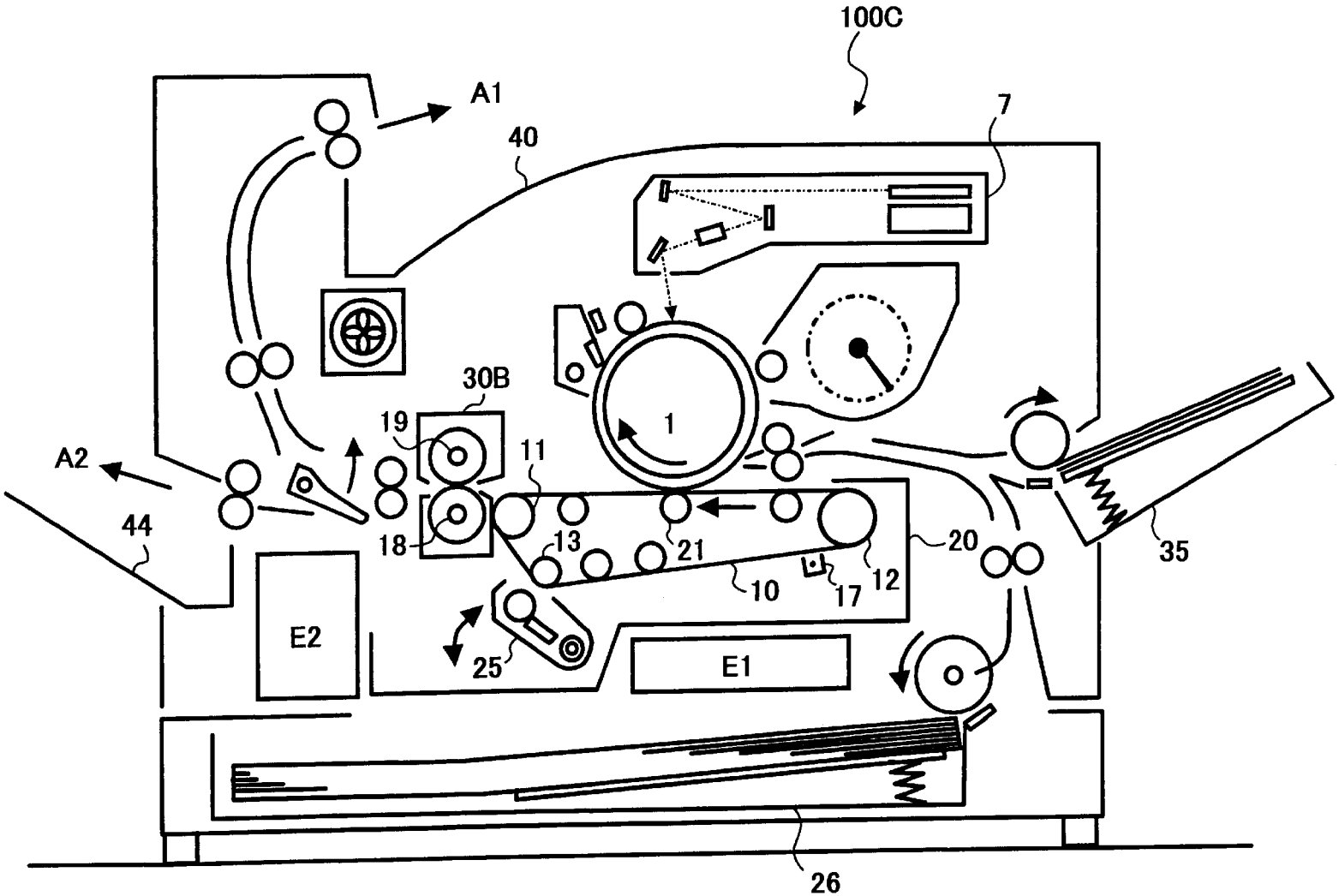
FIG. 6 is a schematic drawing illustrating another example of a printer in which a polarity of a toner image on an intermediate transfer belt is reversed.

FIG. 6 is a schematic drawing illustrating another example of a printer 100C in which a polarity of a toner image on the intermediate transfer belt 10 is reversed. As illustrated in FIG. 6, a charging device 17 (i.e., a charger) is provided below the intermediate transfer belt 10 and adjacent to a driven roller 12. The second transfer device 22 (see FIGS. 1 and 4) is not employed. The printer 100C is constructed similar to the printer 100B in FIG. 4 in aspects other than the above-described configuration.

Figure 7A:
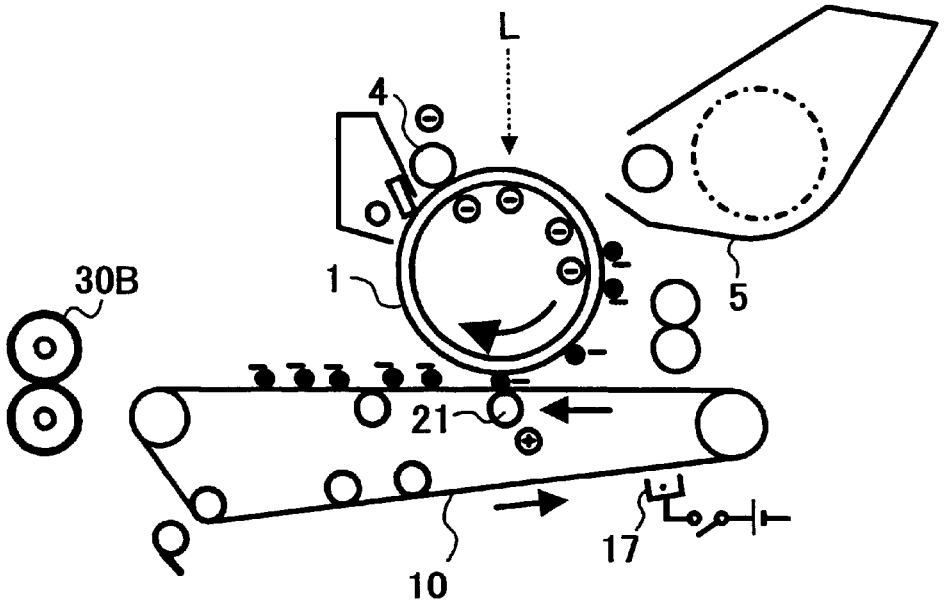
FIGS. 7A–7D are drawings illustrating an image forming process when a both-surfaces printing is performed in the printer illustrated in FIG. 6.
Figure 7B:
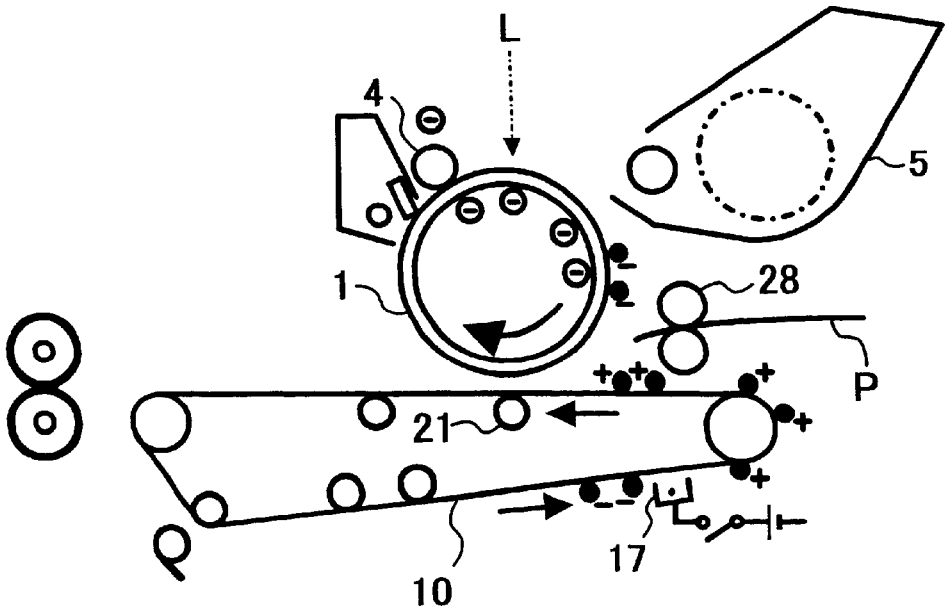
Figure 7C:
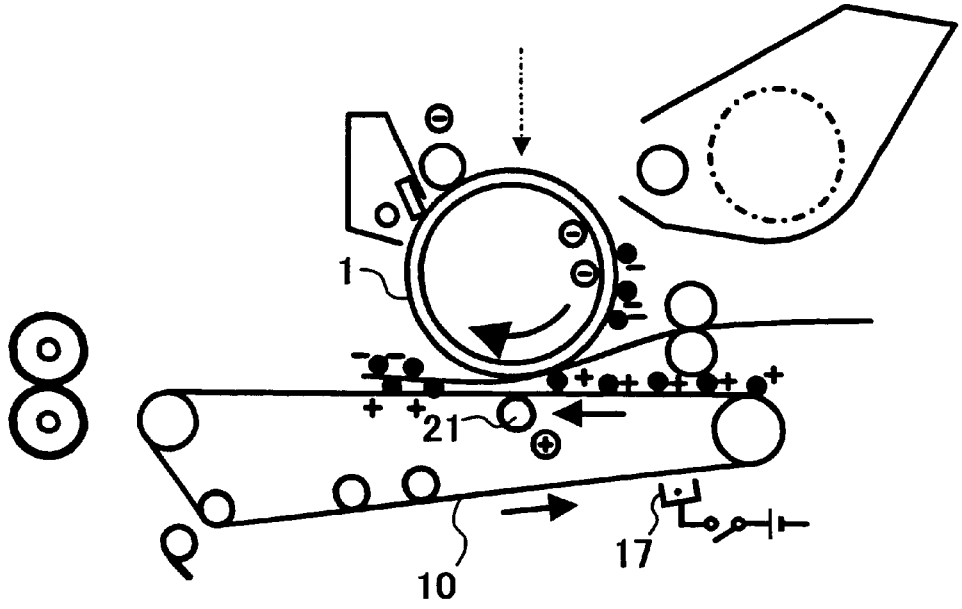
Figure 7D:
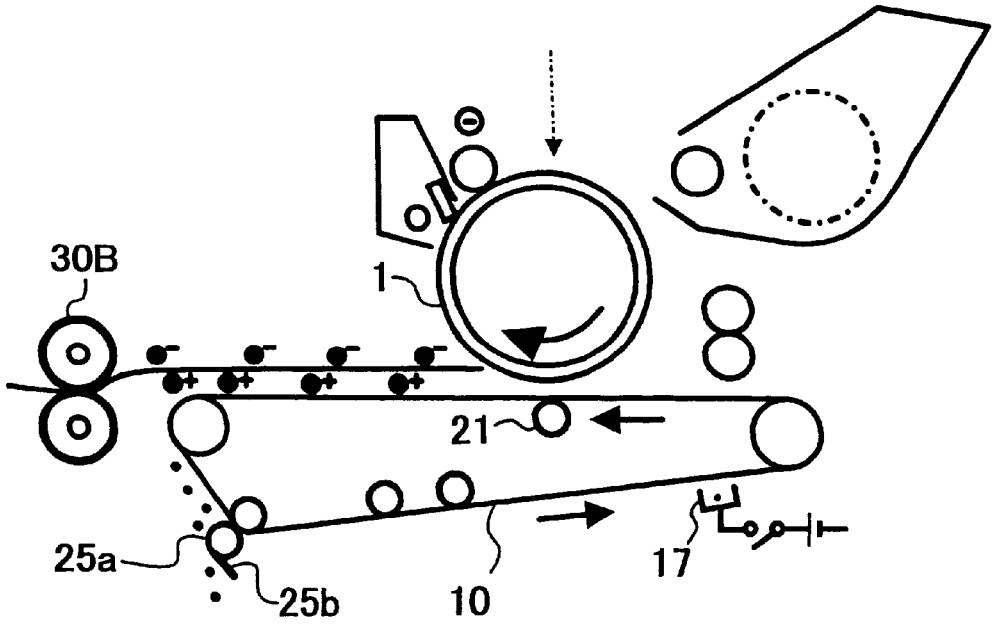

FIGS. 7A–7D show an image forming process when a both-surfaces printing is performed in the printer 100C. FIG. 7A shows a development and a first transfer (i.e., transfer to the intermediate transfer belt 10) operation. FIG. 7B shows a second development operation (i.e., development of an image printed on the second surface of the transfer sheet P). FIG. 7C shows a second transfer operation (i.e., transfer of an image on both surfaces of the transfer sheet P). FIG. 7D shows fixing and belt cleaning operations. In FIGS. 7A–7D, the transfer belt 10 is illustrated to be separated from the photoconductive drum 1 for convenience' sake, however, these are actually in contact with each other.

FIG. 7A shows a process in which (1) the photoconductive drum 1 is negatively charged (–) by the charging device 4, (2) negatively charged (–) toner (indicated by a black circle) is supplied from the developing device 5 to an electrostatic latent image formed by the laser beam L emitted from an exposing device, and (3) the toner image is transferred onto the intermediate transfer belt 10 with a positive (+) voltage applied by the first transfer device 21.

In FIG. 7B, a negatively charged (–) toner image to be printed on the second surface of the transfer sheet P is formed on the surface of the photoconductive drum 1 while the toner image (i.e., first image) is carried and conveyed by the intermediate transfer belt 10. The polarity of the toner image, which is carried and conveyed by the intermediate transfer belt 10, is reversed to the positive polarity by the charging device 17. The pair of registration rollers 28 conveys the transfer sheet P by adjusting the time so that the transfer sheet P is in precise register with these toner images.

In FIG. 7C, these toner images are transferred onto the first and second surfaces of the transfer sheet P, respectively, at one time by the positive voltage (+) applied to the first transfer device 21. The toner image on the intermediate transfer belt 10 (which is positively (+) charged) transfers onto the transfer sheet P by electrostatically repulsing the positive (+) voltage applied to the first transfer device 21. The toner image (which is negatively (–) charged) on the surface of the photoconductive drum 1 is electrostatically attracted and transferred onto the transfer sheet P.

In FIG. 7D, the transfer sheet P is conveyed to the fixing device 30B so that the toner images transferred onto the respective surfaces of the transfer sheet P are fixed. The cleaning device roller 25*a* contacts the intermediate transfer belt 10 to remove residual toner remaining on the surface thereof.

As described above, according to the example of the present invention, a polarity of a toner image carried and conveyed by the intermediate transfer belt 10 (i.e., first transfer operation) is reversed by the charging device 17. Thus, toner images can be transferred onto both surfaces of the transfer sheet P at one time (i.e., second transfer operation) with a single transfer device (i.e., first transfer device 21). The same polarity of voltage is applied to a transfer device both in the first and the second transfer operations, which obviates the necessity for a mechanism to switch the polarity of the voltage applied to the transfer device, resulting in reduced costs. In addition, the voltage is not applied from the second surface of the transfer sheet on which the toner image is transferred (i.e., the second transfer device 22 is not required). Thus, a disturbance of the toner image transferred onto the second surface of the transfer sheet P and an electrostatic offset problem that may occur when the toner image is fixed due to a charge of the transfer sheet P are prevented.

When an image is printed on one surface of the transfer sheet P (i.e., on the surface of the transfer sheet P that is on the side of the photoconductive drum 1), a toner image formed on the surface of the photoconductive drum 1 is directly transferred onto the transfer sheet P. The toner image (i.e., negatively (–) charged) on the surface of the photoconductive drum 1 is attracted to the surface of the transfer sheet P by the first transfer device 21 that is positively (+) charged. However, when an image is printed on the other surface of the transfer sheet P (i.e., on the surface of the transfer sheet P that is on the side of the intermediate transfer belt 10), the polarity of the toner image is switched by the charging device 17.

The above-described polarity of the voltage applied to the photoconductive drum 1 and the first transfer device 21 is an example, which can be arranged in the reverse polarity.

In the printers 100B and 100C illustrated in FIGS. 4 and 6, respectively, when a thick and rigid transfer sheet, such as a cardboard, an envelope, etc. is used, a transfer current is increased by about 10% to 30% compared to that applied when a normal transfer sheet is used as in the printer 100 illustrated in FIG. 1. Further, when the thick and rigid transfer sheet is used, a temperature of the fixing rollers 18 and 19 is increased by about 10% to 30% compared to that for these rollers when the normal transfer sheet is used. In addition, a high level of fixing performance can be attained when the temperature of each fixing roller 18, 19 is individually controlled for one-surface and both-surfaces printing operations. A temperature detecting device (not shown) may be provided to the fixing rollers 18 and 19 such that a heater of each fixing roller 18 and 19 is controlled based on a detection result of the temperature detecting device.

Next, another example of the present invention, in which a full color image is formed on both surfaces of a transfer sheet, is described below. In an image forming apparatus illustrated in FIG. 8, an image forming section PU, which forms a full color image, is arranged approximately in the center of a main body of the apparatus. The image forming section PU includes four image forming units SU. The four image forming units SU are disposed in series along the upper run of an intermediate transfer belt 60 such that they contact the intermediate transfer belt 60. The intermediate transfer belt 60 is spanned around rollers 61, 62, 63, and 64. The exposure device is arranged above the four image forming units SU. Because the structure of each of the image forming units SU is identical except for a color of toner used, an explanation is made based on one of the image forming units SU as being representative referring to FIG. 9.

Figure 9:
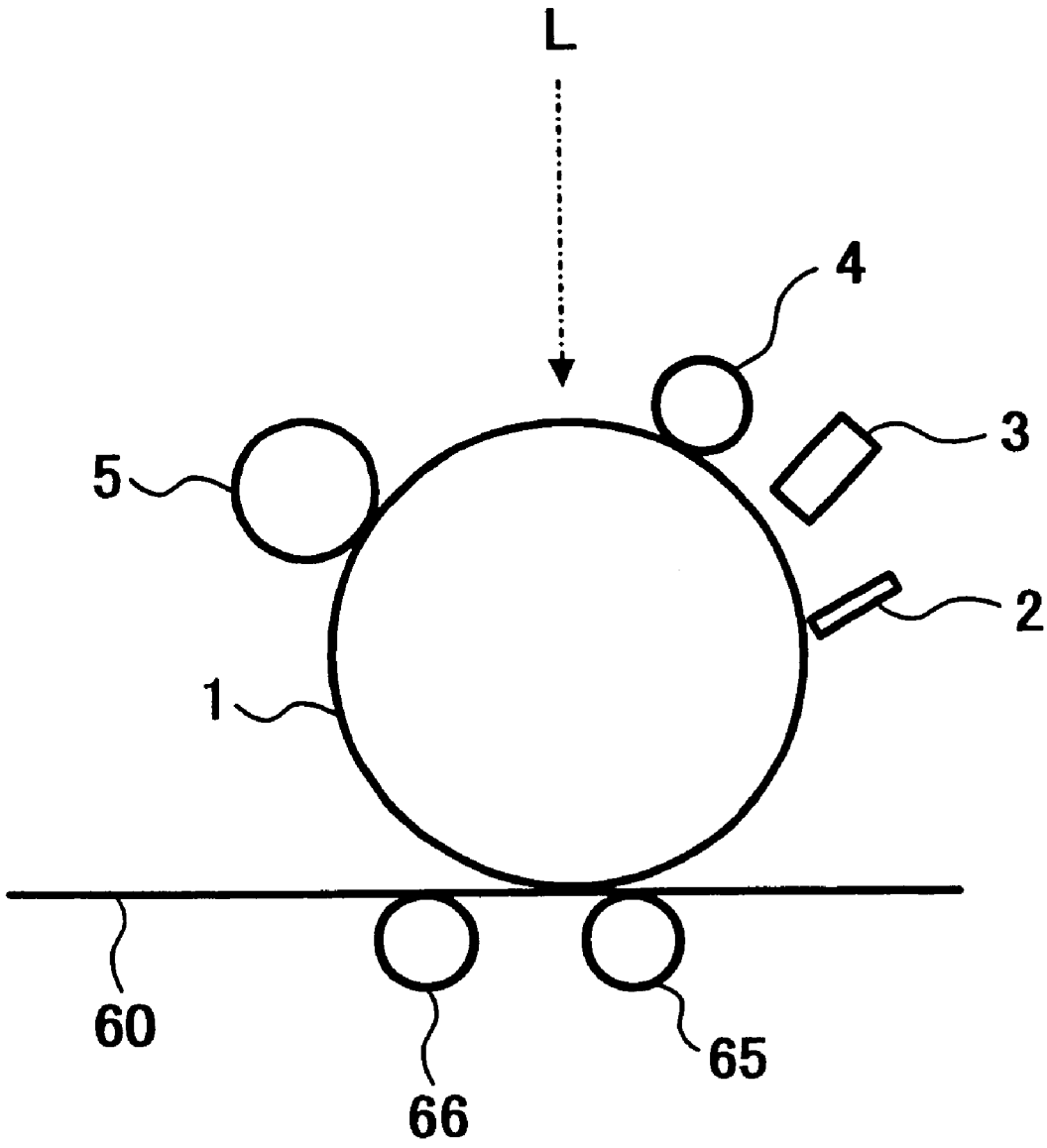
FIG. 9 is a drawing illustrating a construction of an image forming unit of the printer illustrated in FIG. 8.

As illustrated in FIG. 9, in the image forming unit SU, the cleaning device 2, the discharging device 3, the charging device 4, and the developing device 5 are provided around the photoconductive drum 1. Each developing device 5 provided in each image forming unit SU contains cyan, magenta, yellow, and black toner respectively so as to provide each color toner to an electrostatic latent image formed on the surface of the photoconductive element 1. A writing region is formed on the surface of the photoconductive element 1 between the charging device 4 and the developing device 5. The writing region is irradiated with the laser beam L emitted from the exposure device 7. The exposure device 7 is of a commonly known laser beam type. According to the example of the present invention, color separated optical information corresponding to the color of the toner to be developed is irradiated onto the uniformly charged surface of the photoconductive drum 1 so as to form the electrostatic latent image thereon. An exposure device including a LED array and an image focusing device may also be employed. A transfer roller 65 is provided at a position opposed to the photoconductive drum 1 via the intermediate transfer belt 60. A reference numeral 66 denotes a backing roller. A toner image formed on the surface of the photoconductive drum 1 is transferred onto the intermediate transfer belt 60 using the transfer roller 65.

Cyan, magenta, yellow, and black toner images formed on the surface of respective photoconductive elements 1 in each of four image forming units SU are transferred onto the intermediate transfer belt 10 one after another so that a full color toner image is formed thereon. When a black and white toner image is formed, the toner image is formed only in the image forming unit SU that contains black toner. The formed black and white toner image is then transferred onto the intermediate transfer belt 60.

A belt-type transfer member 110 is provided below the image forming section PU. The transfer member 110 is spanned around rollers 111, 112, 113, and 114 such that it rotates in a counterclockwise direction as indicated by an arrow in FIG. 8. The transfer roller 21 (i.e., a transfer device) is arranged at a position opposed to the roller 63, which supports the intermediate transfer belt 60 in the image forming section PU, within a space between the upper and lower runs of the horizontally extended intermediate transfer member 110. The belt cleaning device 25 and the transfer device (i.e., transfer charger) are disposed outside the run of the intermediate transfer member 110. The intermediate transfer belt 60 and the intermediate transfer member 110 contact each other to form a predetermined nip by the transfer roller 21, the roller 114, and the roller 63.

Sheet feeding devices (i.e., sheet feeding cassettes) 26-1, 26-2, and 26-3 are provided in a lower portion of the apparatus. The uppermost transfer sheet stacked in each sheet feeding cassette is fed sheet-by-sheet by the sheet feeding roller 27 and is conveyed to the pair of the registration rollers 28.

The fixing device 30B is disposed on the left side of the intermediate transfer member 110. The construction of the fixing device 30B is identical to that illustrated in FIG. 4. According to the example of the present invention, a toner image formed in the image forming section PU is borne by the intermediate transfer belt 10. The toner image is then transferred onto one surface of a transfer sheet conveyed by the pair of the registration rollers 28 or the intermediate transfer member 110.

According to the example of the present invention, when images are printed on both surfaces of a transfer sheet, a first image formed in the image forming section PU is transferred onto the intermediate transfer member 110 from the intermediate transfer belt 60. A second image is then formed in the image forming section PU. The second image transferred onto the intermediate transfer belt 60 is transferred onto a second surface of the transfer sheet that is conveyed by the pair of registration rollers 28. The transfer operation of the second image is performed using the transfer roller 21 provided within a space between the upper and lower runs of the intermediate transfer member 110. The first image carried and conveyed by the intermediate transfer member 110 is brought into register with the first surface of the transfer sheet. The transfer sheet having the second surface onto which the second image is transferred and the first surface that is in register with the first image carried on the intermediate transfer member 110 is conveyed to the left. The first image on the intermediate transfer member 110 is transferred onto the first surface of the transfer sheet by the transfer charger 22.

The transfer sheet having toner images on both surfaces thereof is separated from the intermediate transfer member 110 at a curvature of the roller 111 so that the toner images are fixed onto the transfer sheet by the fixing device 30B. The transfer sheet is then discharged either to the sheet discharging tray 40 or the exit tray 44.

When an image is printed only on one surface of the transfer sheet, a transfer operation of the image to the intermediate transfer member 110 is not required. The image formed in the image forming section PU is directly transferred onto the transfer sheet from the intermediate transfer belt 60. However, when the transfer sheet is discharged to the exit tray 44 while collating the transfer sheet by page, an image may be transferred onto the underside of the transfer sheet via the intermediate transfer member 110 when a one-surface printing is performed.

As described above, according to the example of the present invention, a toner image formed in the image forming section PU is transferred onto the intermediate transfer member 110 or onto a transfer sheet via the intermediate transfer belt 60. Thus, the intermediate transfer belt 60 and the intermediate transfer member 110 correspond to first and second image bearing members, respectively.

When an image is printed on a transfer sheet that has a large return force by a resilience of a slack in the transfer sheet, a both-surfaces printing while collating the printed transfer sheet by page can be performed using the manual sheet feeding device 35 and designating the exit tray 44 where the printed transfer sheets are discharged. When a normal transfer sheet is used, the transfer sheet can be fed either by the sheet feeding cassettes 26-1, 26-2, and 26-3, or manual sheet feeding device 35, and either the sheet discharge tray 40 or the exit tray 44 can be designated. In this case, a both-surfaces printing while collating the printed transfer sheet by page can be performed. In a one-surface printing, when an image is printed on the transfer sheet that has a large return force caused by the resilience of the slack in the transfer sheet, such as a cardboard, an OHP film, and the like, the one-surface printing while collating the printed transfer sheets by page can be performed by feeding the transfer sheet using the manual sheet feeding device 35 and designating the exit tray 44 where the printed transfer sheets are discharged without being reversed.

In this example of the present invention, when a thick and rigid transfer sheet (such as a cardboard, an envelope, etc.) is used, a transfer current is increased by about 10% to 30% compared to that applied when a normal transfer sheet is used, as in the example described referring to FIG. 1. Further, when the thick and rigid transfer sheet is used, a temperature of the fixing rollers 18 and 19 is increased by about 10% to 30% compared to the temperature of those rollers when the normal transfer sheet is used. When the temperature of the fixing rollers 18 and 19 is independently controlled based on one-surface and both-surfaces printings, further appropriate fixing performance is accomplished. A temperature detecting device may be provided to each fixing roller 18 and 19 such that respective heaters of the fixing rollers 18 and 19 are controlled based on a detection of the temperature detecting device.

Figure 10A:
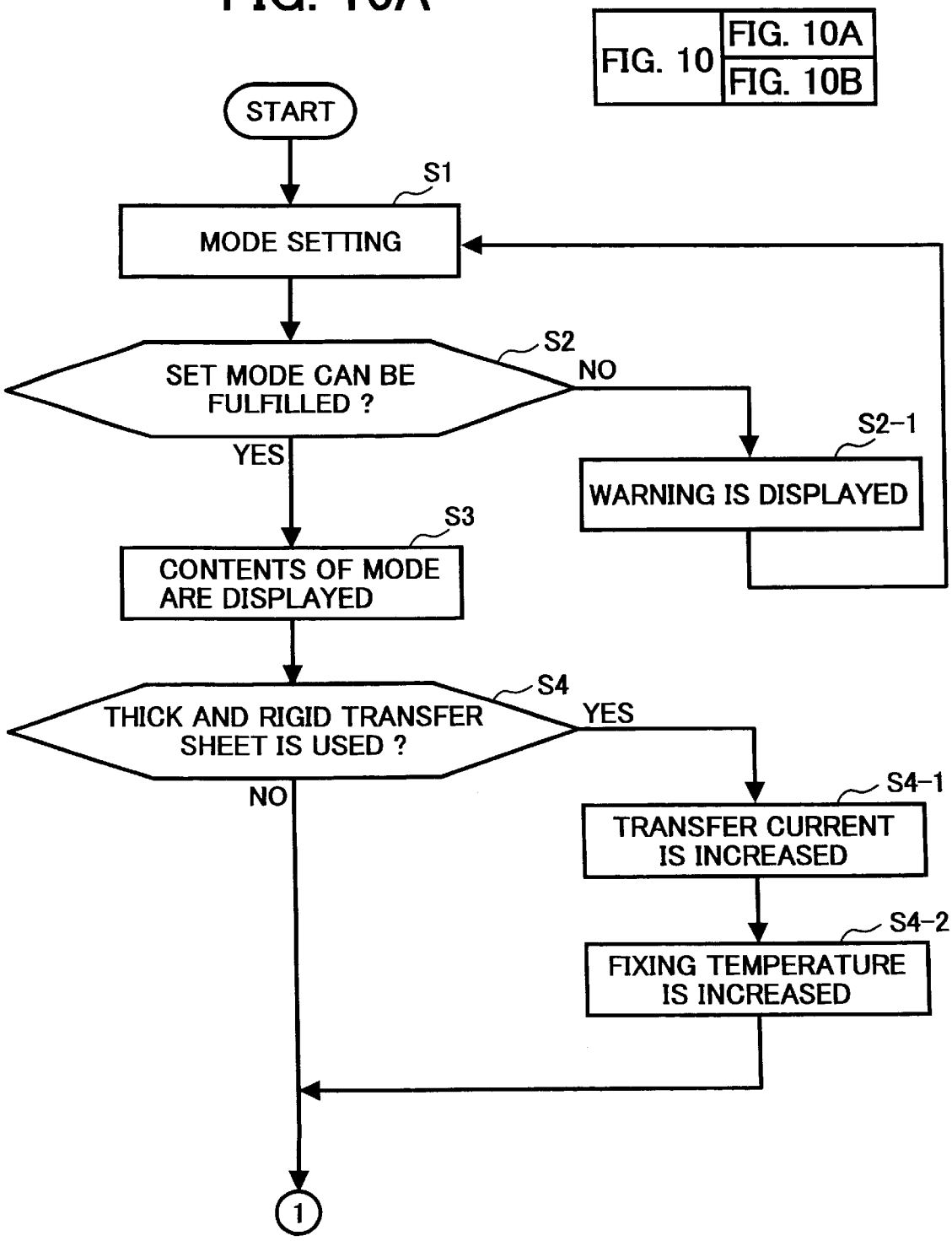
FIGS. 10A–10B are a flowchart illustrating a control of an image forming condition based on a property of a transfer sheet.
Figure 10B:
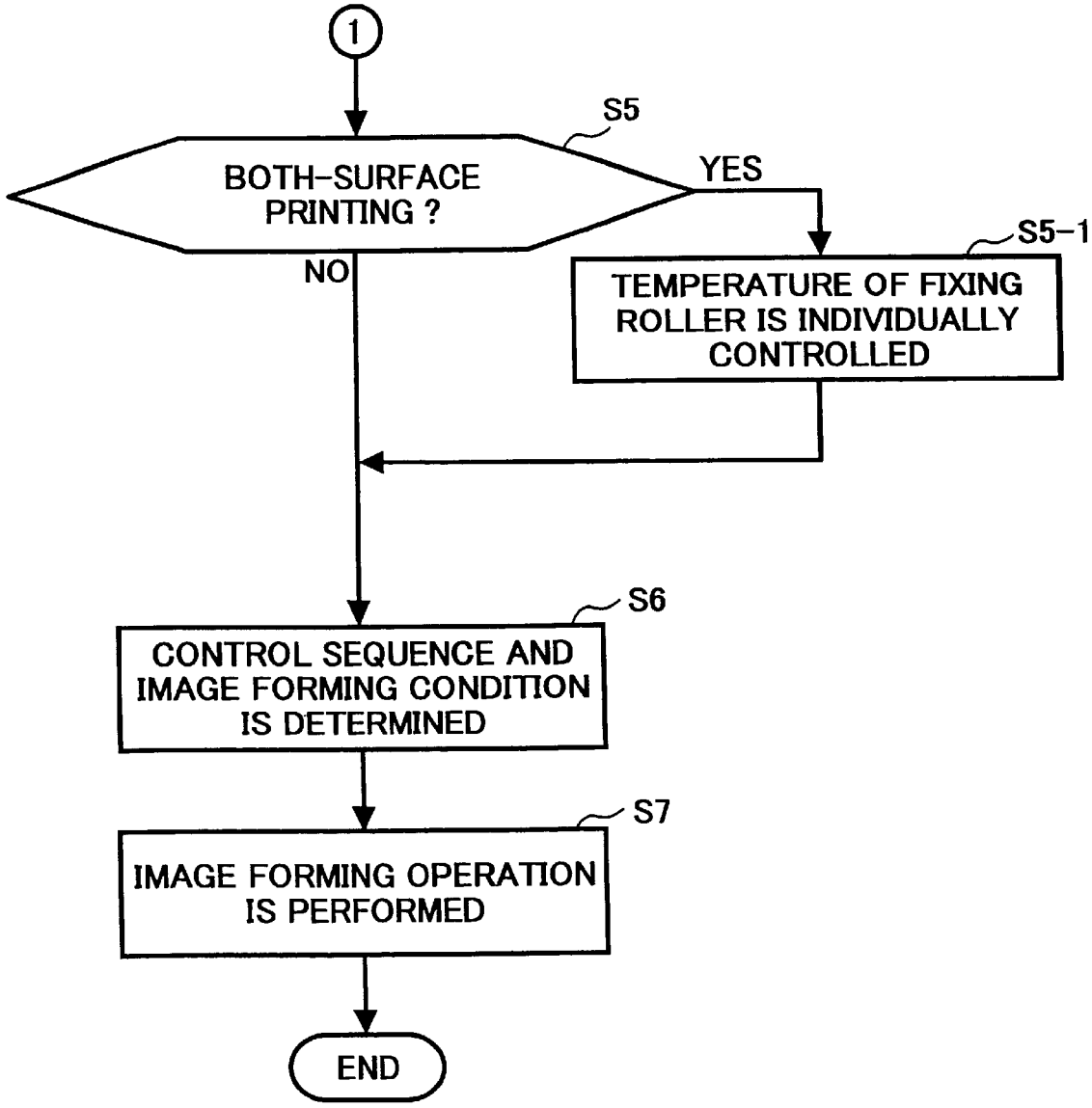

A control of an image forming condition according to a property of a used transfer sheet is described below referring to a flowchart illustrated in FIGS. 10A, 10B.

A mode setting is made by a user through an operation panel of an image forming apparatus or a host computer at step S1. The mode setting includes a designation of a sheet feeding cassette, a sheet discharging tray and a type of a transfer sheet to be used. Whether or not the designated mode can be performed is determined at step S2. For example, when a mode in which a thick and rigid transfer sheet and the sheet discharge tray 40 are designated is selected, it is determined that the set mode is not fulfilled. Further, it is determined that a set mode is not fulfilled when the thick and rigid transfer sheet is designated and one of the sheet feeding cassettes 26-1, 26-2, 26-3 is designated for feeding the thick and rigid transfer sheet. When it is determined that the selected mode is not fulfilled at step S2 (i.e., "No" at step S2), a warning is displayed on a screen of the operation panel and/or a monitor of a host computer at step S2-1 so as to notify the erroneous mode setting. When the set mode can be fulfilled (i.e., "Yes" at step S2), the contents of the set mode are displayed on the screen of the operation panel and/or the monitor of the host computer at step S3.

When the thick and rigid transfer sheet is designated in the set mode, the process proceeds to step S4-1 from step S4. A transfer condition is set such that a transfer current is increased by about 10% to 30% compared to that applied when a normal transfer sheet is used. The process further proceeds to step S4-2. Thus, a fixing temperature is set such that the fixing temperature is increased by about 10% to 30% compared to that when the normal transfer sheet is used. When the normal transfer sheet is designated in the set mode, the process proceeds to step S5 without increasing the transfer current and the fixing temperature. Whether or not a both-surfaces printing is designated is determined at step S5. When the both-surfaces printing is designated (i.e., "Yes" at step S5), the process proceeds to S5-1 to independently control the temperature of the fixing rollers 18 and 19. At step S6, a control sequence (i.e., the order of pages of the formed images, and whether or not an image is transferred onto the second image bearing member, etc.) and image forming conditions (i.e., a transfer current, a fixing temperature, etc.) are determined according to the set mode and conditions. Then, an image forming operation is performed at step S7.

Figure 11:
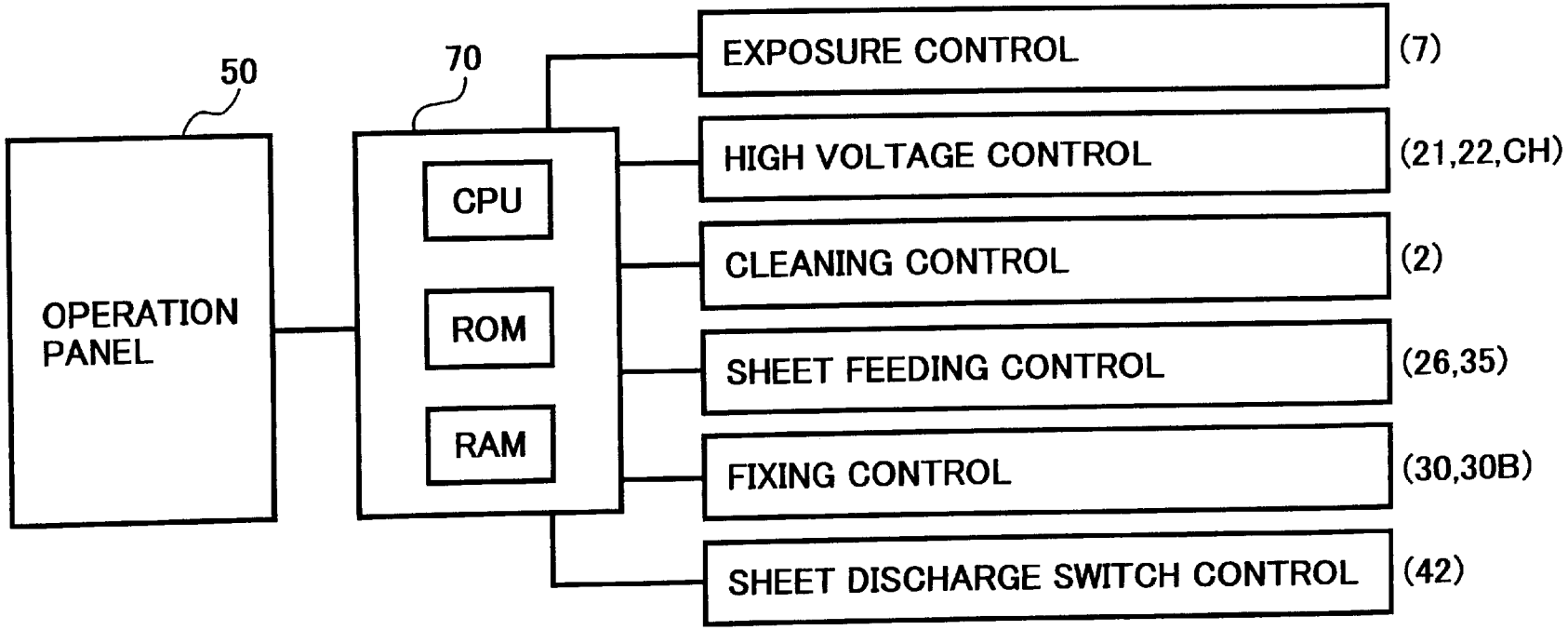
FIG. 11 is a block diagram illustrating a control section of a printer.

FIG. 11 is a block diagram illustrating a control section that exerts the above-described control. A main control board 70 includes a CPU, a ROM, and a RAM. The main control board 70 controls the exposure device 7, transfer devices 21, 22 and CH, cleaning device 2, sheet feeding devices 26 and 35, fixing devices 30 and 30B, and switching pick 42. The main control board displays the contents of the set mode and an alarm on the operation panel 50 or outputs them to a host computer.

Figure 12:
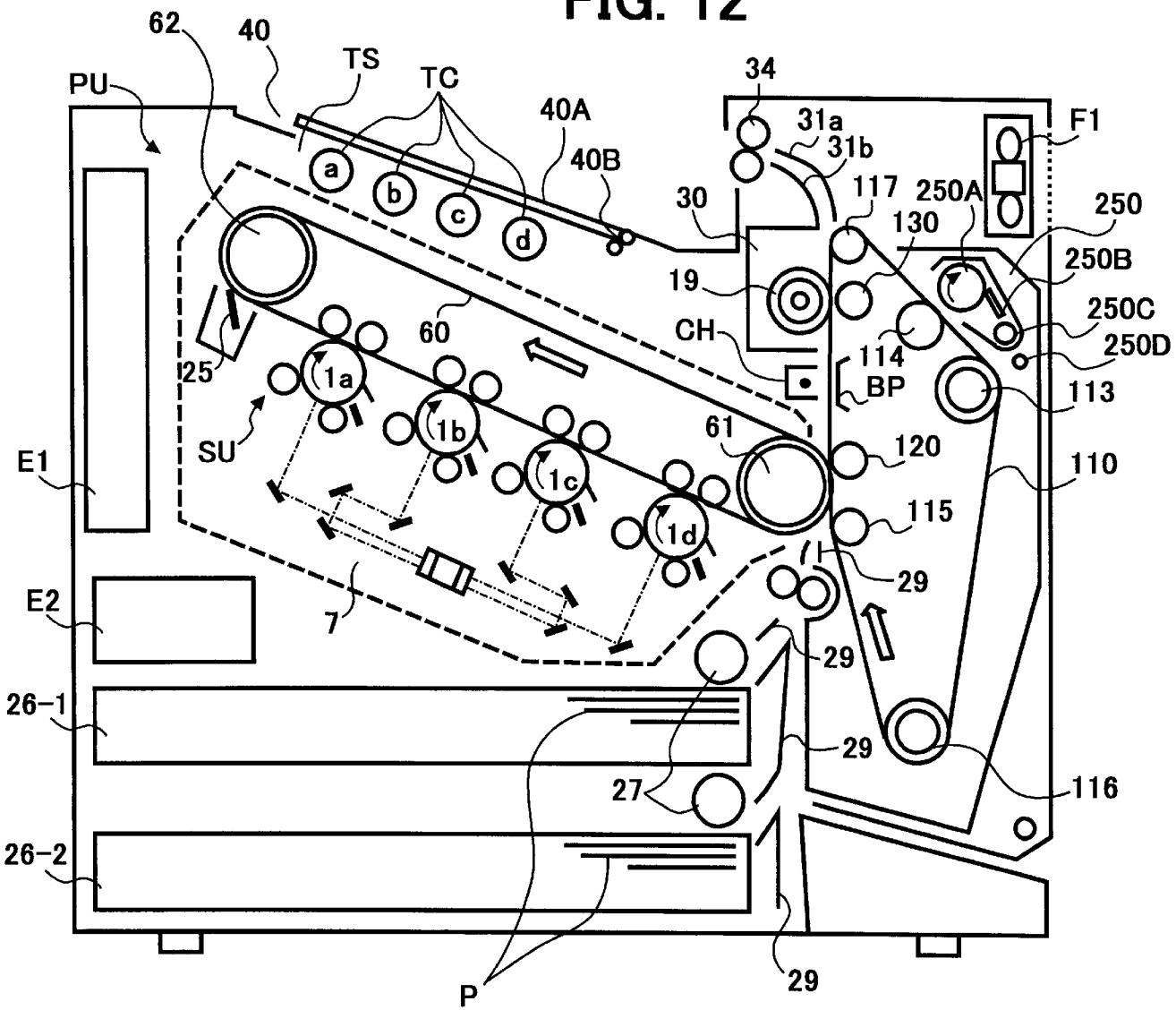
FIG. 12 is a schematic drawing illustrating a sectional view of another example of an image forming apparatus which is capable of forming a full color image.

FIG. 12 is a schematic drawing illustrating a sectional view of an image forming apparatus that is capable of forming a full color image according to another example of the present invention. In the image forming apparatus, the image forming section PU is arranged approximately in the center of a main body of the apparatus. The image forming section PU includes four image forming units SU. The four image forming units SU are provided in series along the lower run of the inclined intermediate transfer belt 60 such that they contact the intermediate transfer belt 60. The exposure device 7 is disposed below the image forming units SU. The construction of each image forming unit SU is identical to that described in FIG. 9 except for a position of the surrounding components.

The intermediate transfer belt 60 rotates in a counterclockwise direction as indicated by an arrow in FIG. 12 while being spanned around the driving roller 61 and the driven roller 62. The belt cleaning device 25 is provided at the position of the driven roller 62. A toner containing section TS including a toner cartridge TC that contains replenishing toner is disposed above the intermediate transfer belt 60. Each toner cartridge labeled with "a" to "d" contains cyan, magenta, yellow, and black toner, respectively. Each color toner is supplied to the corresponding developing device by a powder pump (not shown).

Each cyan, magenta, yellow, and black toner image formed on the surface of the respective photoconductive drums 1*a*–1*d* is transferred onto the intermediate transfer belt 60 one after another so that a full color image is formed thereon. When a black and white image is formed, the image is formed in the image forming unit SU that contains black toner. The formed black and white image is then transferred onto the intermediate transfer belt 60.

The intermediate transfer member 110 is provided on the right side of the image forming section PU. The intermediate transfer member 110 is spanned around rollers 113, 115, 116, and 117 such that it rotates in a counterclockwise direction as illustrated by an arrow in FIG. 12. A transfer roller 120, which is a transfer device, is arranged adjacent to the roller 61, which supports the intermediate transfer belt 60, within a run of the intermediate transfer member 110. Further, a heating roller 130, rollers 114 and 115, and a backing plate BP are disposed within the run of the intermediate transfer member 110. The roller 116 also serves as a cooling device. A belt cleaning device 250 and a charger CH are provided outside the run of the intermediate transfer member 110. The belt cleaning device 250 includes a roller 250A, a blade 250B, and a toner conveying device 250C inside. The belt cleaning device 250 removes residual toner and paper powder remaining on the surface of the intermediate transfer member 110 after a toner image is transferred onto a transfer sheet. In FIG. 12, the roller 250A is separated from the surface of the intermediate transfer member 110. The roller 250A is configured to be rotatable over a fulcrum 250D such that it can be brought into contact with or separated from the surface of the intermediate transfer member 110. The roller 250A is separated from the surface of the intermediate transfer belt 60 when the intermediate transfer member 110 carries a toner image to be transferred onto a transfer sheet. The roller 250A is rotated in a counterclockwise direction in FIG. 12 so as to contact the surface of the intermediate transfer member 110 when a cleaning of the intermediate transfer member 110 is required.

The intermediate transfer belt 60 and the intermediate transfer member 110 are brought into contact with each other by the transfer roller 120, roller 115, and roller 61 (which supports the intermediate transfer belt 60) so as to form a predetermined nip. The charger CH is arranged outside the run of the intermediate transfer member 110 at a position opposed to the backing plate BP that is disposed above the transfer roller 120.

Sheet feeding devices (i.e., sheet feeding cassettes) 26-1 and 26-2 are vertically arranged below the image forming section PU in a lower portion of the apparatus. The uppermost transfer sheet stacked in each sheet feeding cassette 26-1 and 26-2 is fed sheet-by-sheet by the sheet feeding roller 27 and is conveyed to the pair of registration rollers 28 while being guided by each guide member 29.

The fixing device 30 is provided at a position opposed to the heating roller 130 that is disposed within the run of the intermediate transfer member 110. The fixing device 30 is configured such that the fixing roller 19 is brought into contact with the intermediate transfer member 110 by a contact/separation mechanism (not shown) as in the fixing device 30 described referring to FIG. 1. In FIG. 12, the fixing roller 19 is brought into contact with the intermediate transfer member 110.

When a both-surfaces printing is performed, the first image formed in the image forming section PU is transferred onto the intermediate transfer member 110 from the intermediate transfer belt 60. The second image is then formed in the image forming section PU. The second image is transferred onto the second surface of a transfer sheet, which is conveyed by the pair of registration rollers 28, from the intermediate transfer belt 60. The transfer of the second image is performed by the transfer roller 120 which is disposed within the run of the intermediate transfer member 110. The first image transferred on the intermediate transfer member 110 that is circled while being carried by the intermediate transfer member 110 is brought in register with the first surface of the transfer sheet. The transfer sheet having the second surface onto which the second image is transferred and the first surface which is in register with the first image carried on the intermediate transfer member 110 is conveyed in an upward direction by the intermediate transfer member 110. The first image carried on the intermediate transfer member 110 is transferred onto the first surface of the transfer sheet by the charger CH. The transfer sheet having toner images on the both surfaces thereof is conveyed to a fixing region. The toner images are fixed onto the transfer sheet by the fixing roller 19 of the fixing device 30 and the heating roller 130. When a fixing operation is performed, the fixing roller 19 of the fixing device 30 is brought into press-contact with the heating roller 130 via the intermediate transfer member 110. The transfer sheet having fixed toner images is discharged to the sheet discharge tray 40 by the pair of sheet discharging rollers 34.

When a one-surface printing is performed, an image is not transferred onto the intermediate transfer member 110. The image formed in the image forming section PU is directly transferred onto a transfer sheet from the intermediate transfer belt 10.

As described above, according to the example of the present invention, a toner image formed in the image forming section PU is transferred onto the transfer sheet or the intermediate transfer member 110 from the intermediate transfer belt 60. Thus, the intermediate transfer belt 60 in the image forming section PU and the intermediate transfer member 110 correspond to first and second image bearing members, respectively.

In this example of the present invention, when a thick and rigid transfer sheet, such as a cardboard, an envelope, etc. is used, a transfer current is increased by about 10% to 30% compared to that applied when a normal transfer sheet is used as in the above-described example. When the thick and rigid transfer sheet is used, a fixing temperature is increased by about 10% to 30% compared to that when the normal transfer sheet is used. When the temperatures of the fixing roller 19 and the heating roller 130 are independently controlled based on a one-surface and both-surfaces printing, further appropriate fixing performance is accomplished. A temperature detecting device may be provided to the fixing roller 19 and the heating roller 130 such that respective heaters of the fixing roller 18 and the heating roller 130 are controlled based on a detection of the temperature detecting device.

The apparatus according to this example does not include a manual sheet feeding device and an exit tray provided to the side of a main body of the apparatus. However, because a transfer sheet is fed from the sheet feeding cassettes 26-1 and 26-2 and is discharged to the sheet discharging tray 40, a transfer sheet conveying path is arranged comparatively in a straight line. Thus, a thick and rigid transfer sheet can be used.

Figure 13:
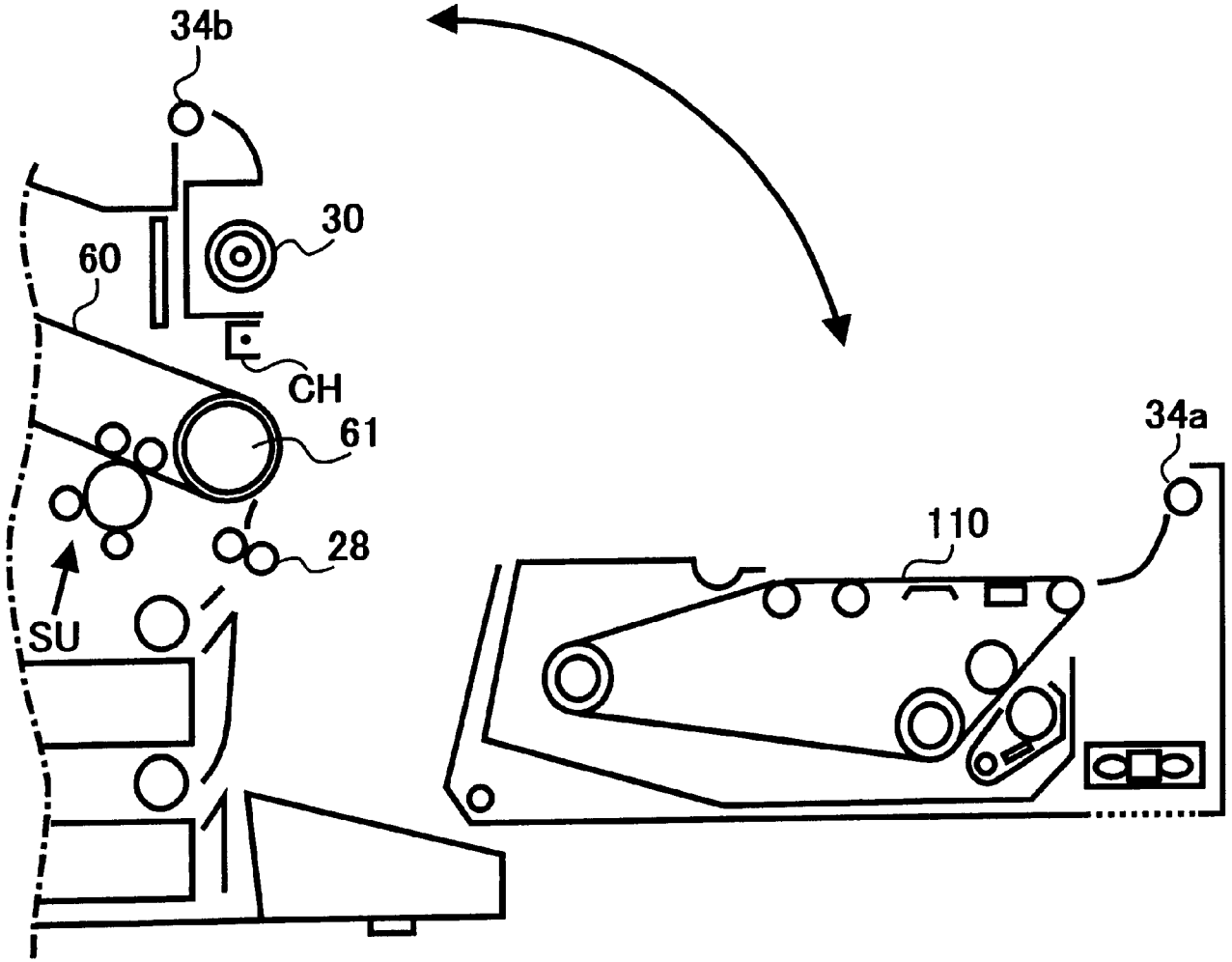
FIG. 13 is a partial sectional view illustrating the image forming apparatus illustrated in FIG. 12 when a portion of the image forming apparatus including a sheet conveying path is opened.

As illustrated in FIG. 13, a portion of the apparatus including the intermediate transfer member 110 is opened relative to the main body of the apparatus. The open portion of the apparatus includes the intermediate transfer member 110, components arranged within the run of the intermediate transfer member 110, the belt cleaning device 250, and so forth. An upper roller 34*a* of the pair of the sheet discharging rollers 34 is provided to the open portion and a lower roller 34*b* of the pair of the sheet discharging rollers 34 is provided to the main body of the apparatus. As shown in FIG. 13, when the open portion of the apparatus is opened, a space between sheet feeding cassettes provided in a lower portion of the apparatus and the pair of sheet discharging rollers 34 provided in an upper portion of the apparatus is opened, thereby improving a removability of a jammed sheet.

Figure 14:
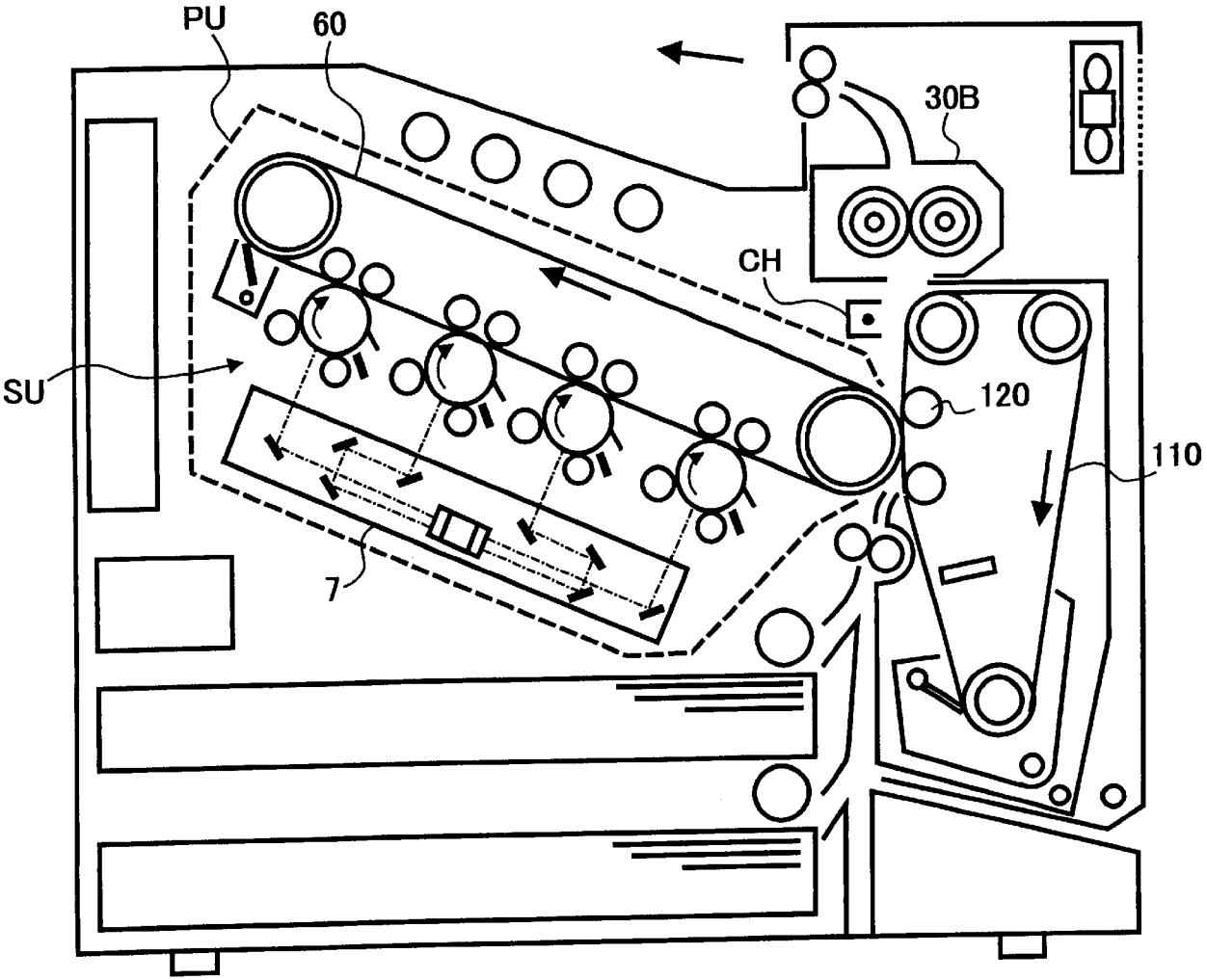
FIG. 14 is a schematic drawing illustrating another example of an image forming apparatus in which a fixing device is provided at a different position.
Figure 15:
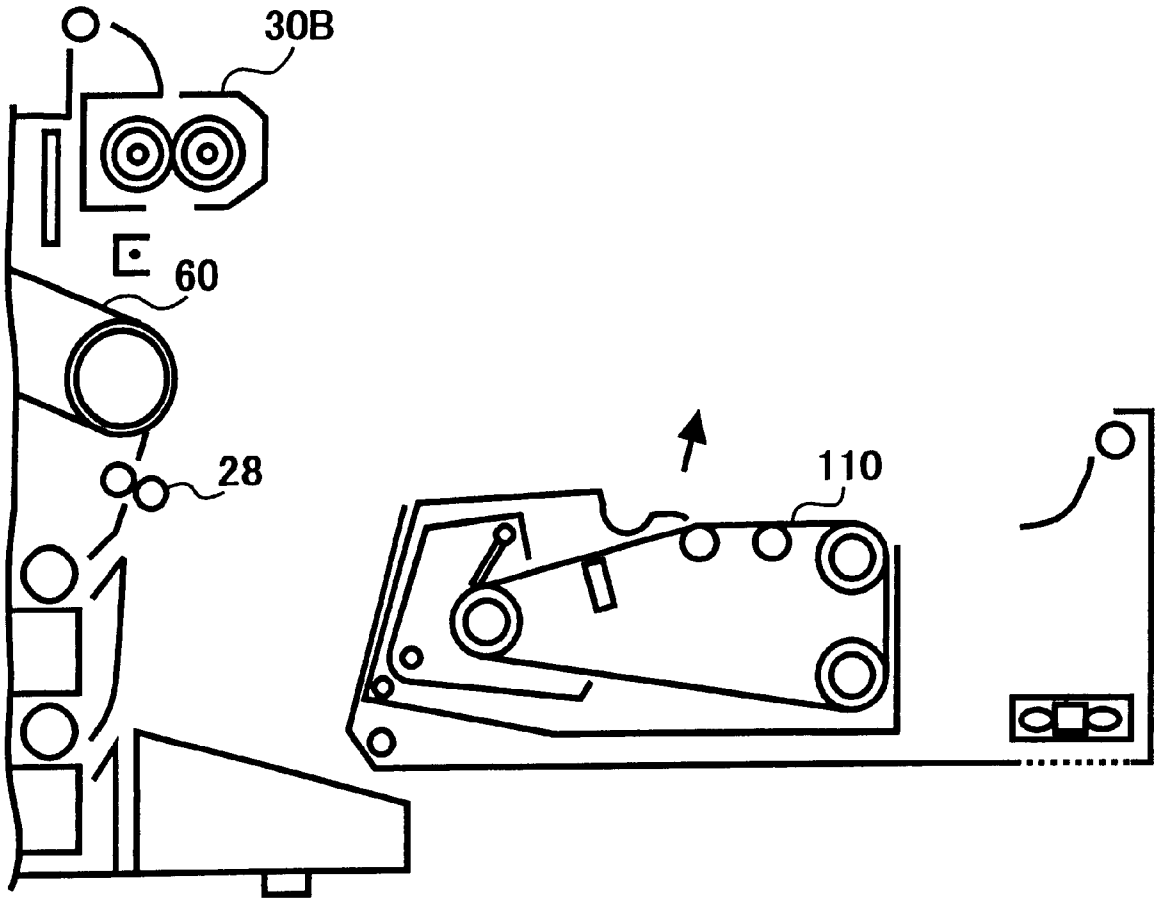
FIG. 15 is a partial sectional view illustrating the image forming apparatus illustrated in FIG. 14 when a portion of the image forming apparatus including a sheet conveying path is opened.

FIG. 14 is a schematic drawing illustrating another example of an image forming apparatus in which the fixing device 30B is provided at a different position from that of the fixing device 30 in FIG. 12 (i.e., the fixing device 30B is separated from the intermediate transfer member 110). Because the structure of the apparatus is identical to that illustrated in FIG. 12 except for the location of the fixing device 30B, explanation of the devices similar to those in FIG. 12 are omitted. As shown in FIG. 15, the fixing device 30B is fixedly provided to a main body of the apparatus. Thus, when the open portion is opened, the fixing device 30B is supported by the main body of the apparatus. If the fixing device 30B is configured such that two fixing rollers are separated when the open portion is opened, a removability of a jammed sheet is improved.

Figure 16:
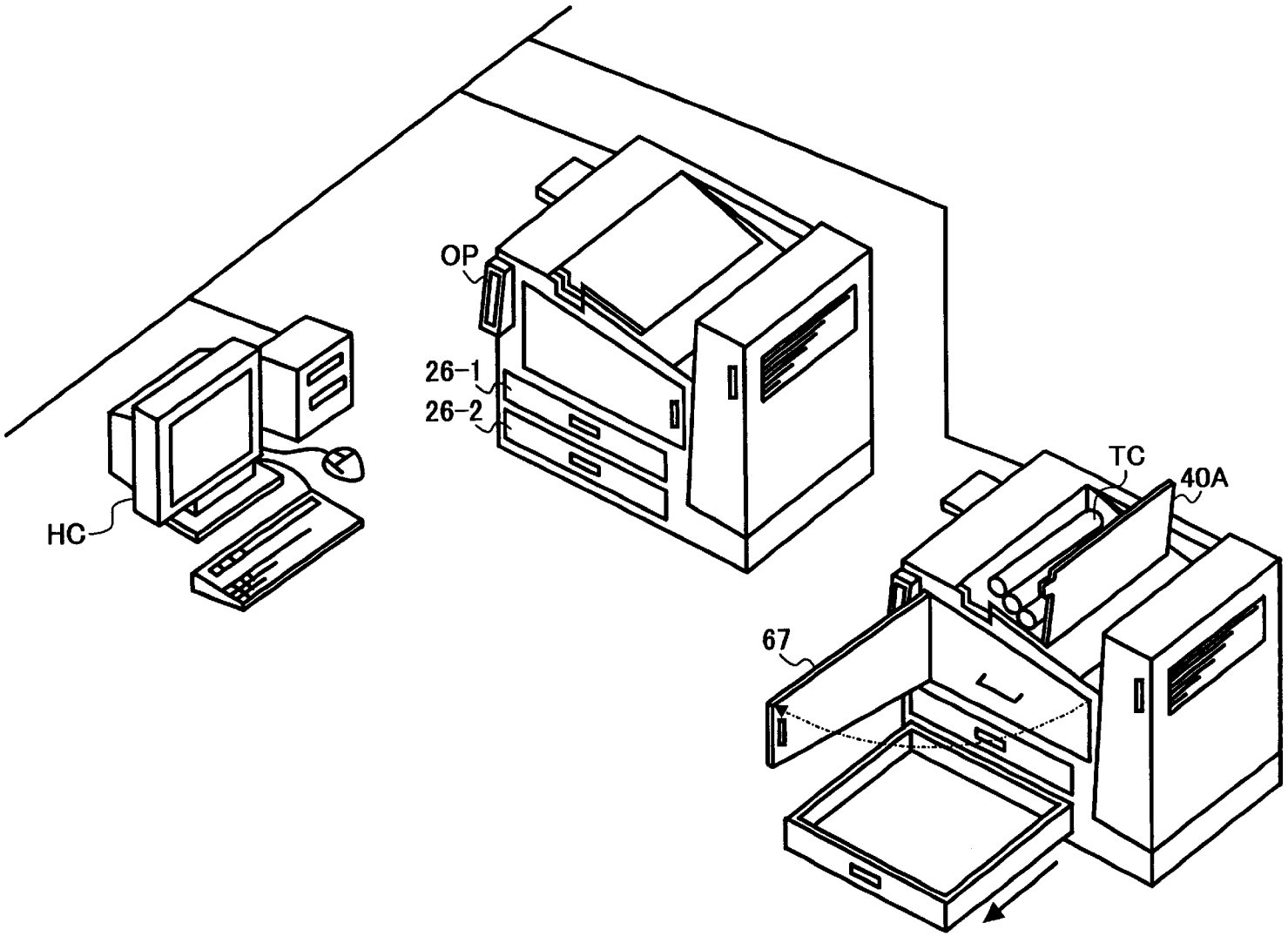
FIG. 16 is a diagram illustrating two printers, which are illustrated in FIG. 12 or FIG. 14, connected to the host computer on a network.

FIG. 16 is a diagram illustrating two printers, which are illustrated in FIG. 12 or FIG. 14, connected to the host computer HC on a network. The printers may be connected to the host computer HC wirelessly or over-the-air without using a cable. An abbreviated word "OP" denotes an operation panel.

In the printer illustrated in FIG. 12 or FIG. 14, the undersurface of the sheet discharge tray 40 serves as a cover 40A for the toner containing section TS. The cover 40A is opened/closed around a rotation axis 40B. As illustrated in FIG. 16, when the cover 40A is opened, a replacement of a toner cartridge is easily performed. Because the rotation axis 40B is arranged on the side of the pair of sheet discharging rollers 34, the discharged transfer sheets may not drop from the sheet discharge tray 40 and an inconvenience in which the collated pages of the transfer sheets are disordered is obviated even when the cover 40A is opened.

A door 67 provided to the front side of the apparatus is rotatably opened in a direction indicated by an arrow in FIG. 16 around the left side of the door 67. When the door 67 is opened, an operator reaches their hand to the image forming section PU to perform maintenance on the image forming section PU. The image forming section PU including the intermediate transfer belt 60, the four image forming units SU, and components provided around each of the four image forming units SU can be slid out of the apparatus while leaving the exposing device 7 in the main body of the apparatus. The intermediate transfer belt 60 and each image forming unit SU can be removed while the image forming section PU is slid out. Rails (not shown) are provided such that the image forming section PU is slid out on the rails. Because the door 67 is supported by a hinge provided in a direction perpendicular to the door 67, a visibility of maintenance parts is increased when the door 67 is opened. Further, replenishing the sheet feeding cassettes 26-1 and 26-2 with transfer sheets is easily performed. A sealing material (not shown) is arranged such that the component of the exposing device 7 is not contaminated by toner, etc. An exposure operation of the exposing device 7 is performed to form a mirror image and a normal image, which is controlled by a controller (not shown) that controls a writing operation.

Further, the sheet feeding cassettes 26-1 and 26-2 are configured to be slid out in a direction indicated by an arrow in FIG. 16. Replenishment and replacement of transfer sheets are performed while the sheet feeding cassettes 26-1 and 26-2 are slid out. In the printer illustrated on the right end portion of FIG. 16, the door 67 is opened and the sheet feeding cassette 26-2 is slid out.

Figure 17:
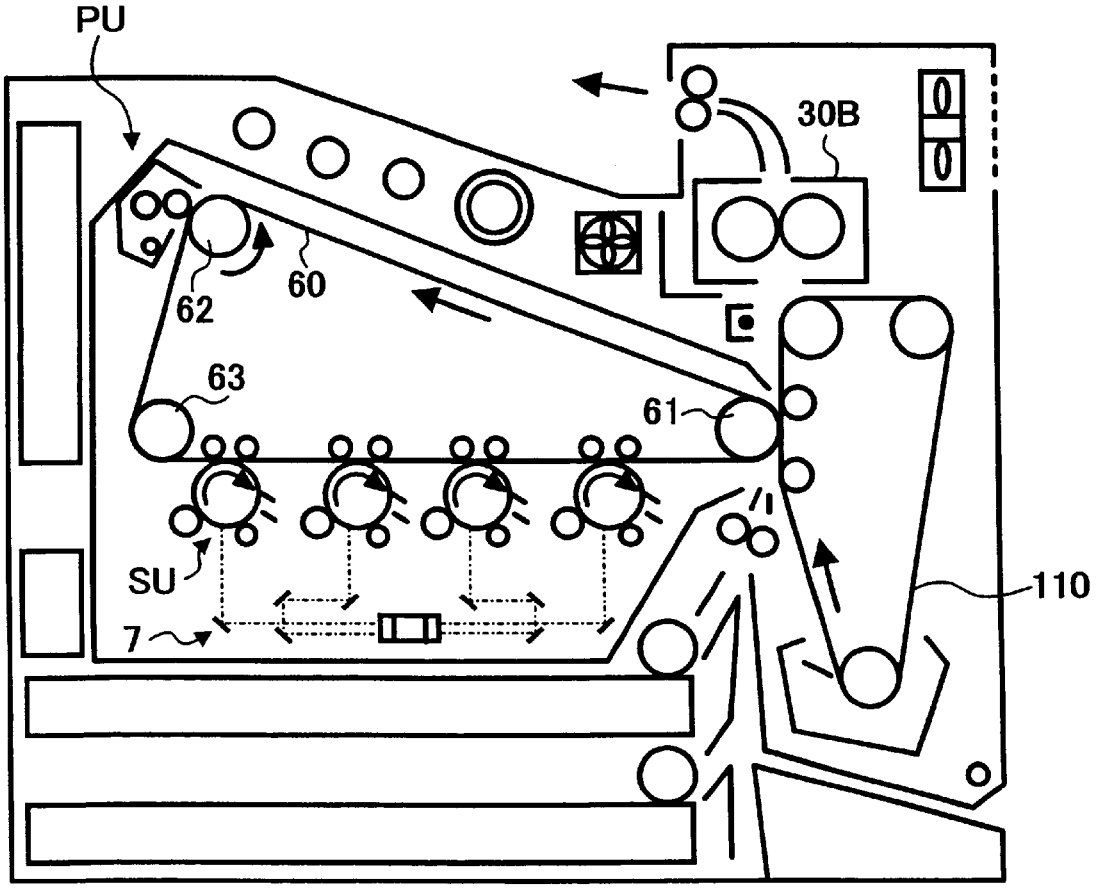
FIG. 17 is a schematic drawing illustrating a sectional view of another example of an image forming apparatus having an image forming section differently constructed from that of the image forming apparatus illustrated in FIG. 14.

FIG. 17 is a schematic drawing illustrating a sectional view of another example of an image forming apparatus in which the construction of the image forming section PU is different from that illustrated in FIG. 14. In this example, the intermediate transfer belt 60 is spanned into a triangle shape in the image forming section PU. The four image forming units SU are horizontally provided in series along the lower run of the intermediate transfer belt 60. The exposing device 7 is horizontally arranged below the four image forming units SU. The construction of this image forming apparatus other than the above-described construction is similar to that illustrated in FIG. 4. Thus, an explanation of the devices similar to those in FIG. 14 is omitted.

Figure 18:
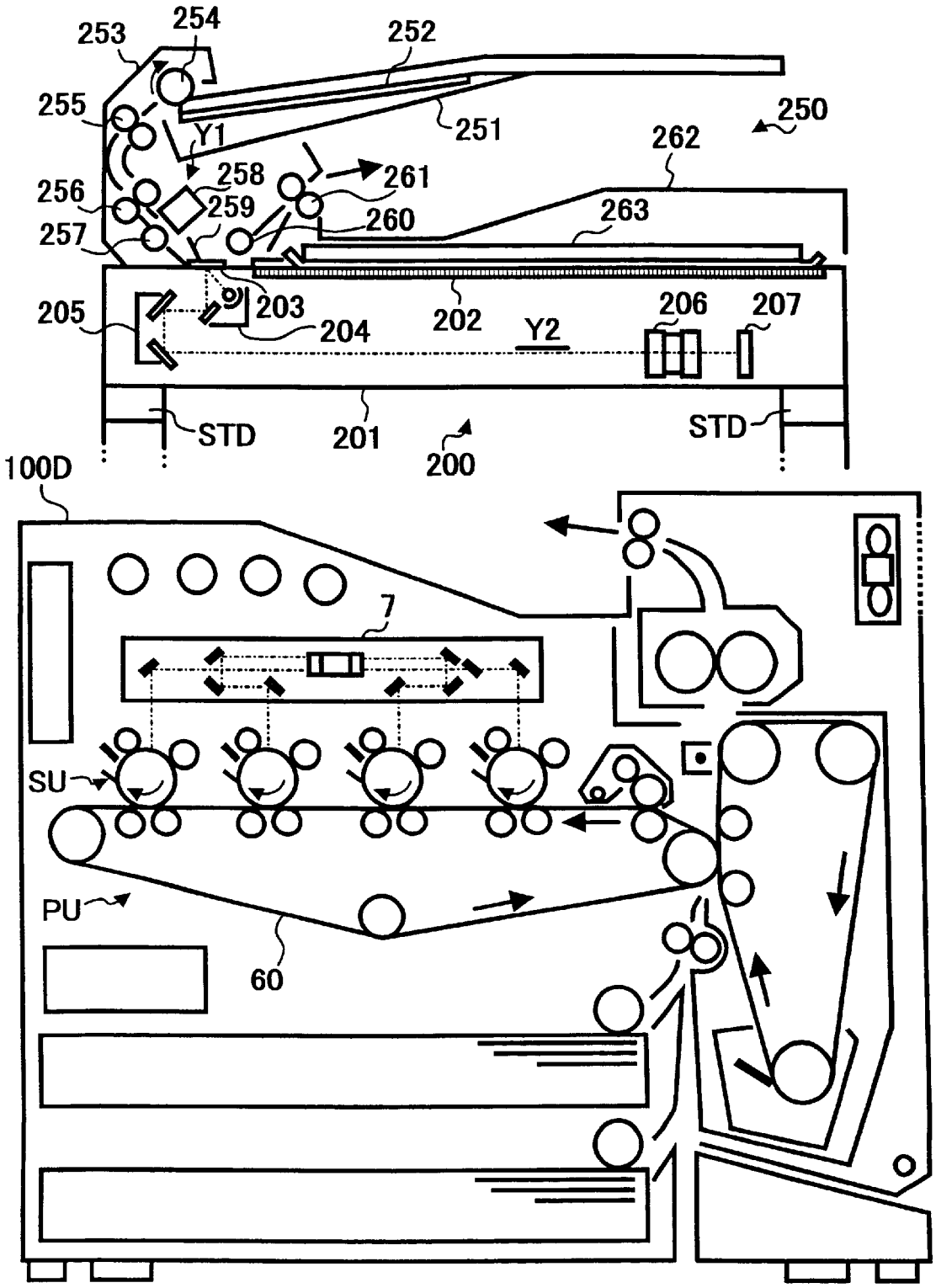
FIG. 18 is a schematic drawing illustrating a sectional view of another example in which the image forming section is differently constructed from those examples illustrated in FIGS. 14 and 17.

FIG. 18 is a schematic drawing illustrating a sectional view of another example in which the image forming section PU is differently constructed from those examples illustrated in FIGS. 14 and 17. According to this example, the intermediate transfer belt 60 is spanned such that the upper run of the intermediate transfer belt 60 is horizontal in the image forming section PU. The four image forming units SU are horizontally disposed in series along the upper run of the intermediate transfer belt 60. Further, the exposing device 7 is horizontally arranged above the four image forming units SU. The construction of this image forming apparatus other than the above-described construction is similar to that illustrated in FIG. 14. Thus, an explanation of the devices similar to those in FIG. 14 is omitted.

Figure 19:
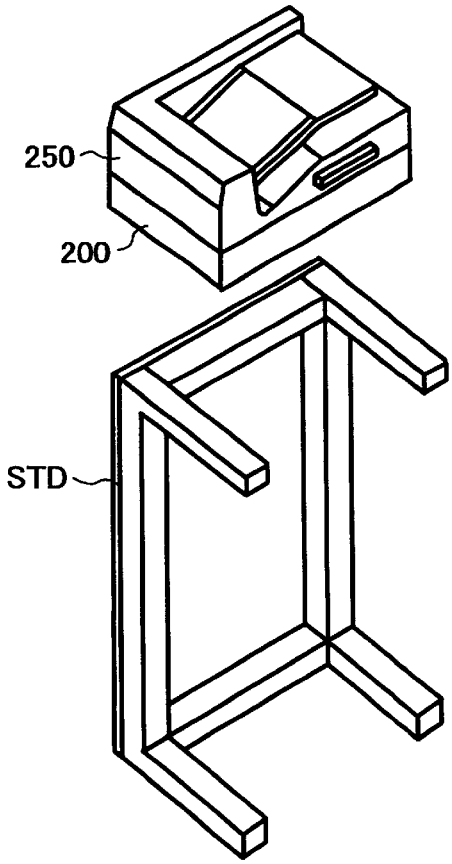
FIG. 19 is a perspective view illustrating an original image reading device, an automatic original document feeder, and a supporting stand.

According to the example illustrated in FIG. 18, an original image reading device 200 and an automatic document feeder ADF 250 are installed on a printer 100D using a supporting stand STD to be used as a copying machine. FIG. 19 is a perspective view illustrating the original image reading device 200, ADF 250, and STD.

The original image reading device 200 and ADF 250 are explained below referring to FIG. 18. Platens 202 and 203 are provided above a frame 201 of the original image reading device 200. The large platen 202 is used when reading an original image while fixedly placing an original document on the platen 202. The small platen 203 is used when reading the original image while conveying the original document by the ADF 250.

A first carriage 204 including a light source and a mirror and a second carriage 205 including two mirrors are movably provided in parallel with the platen 202 in the original image reading device 200. The second carriage 205 moves at half speed of the first carriage 204 employing a commonly known optical system. The first and second carriages 204 and 205 move and scan the image of the original document placed on the platen 202. When reading the image of the original document while the original document is conveyed, the first and second carriages 204 and 205 scan the image of the original document conveyed on the platen 203 while the first and second carriages 204 and 205 stay at a position illustrated in FIG. 18.

The original document is irradiated with the light source. The light reflected from the original document is focused by a fixed lens 206 so as to form an image on a CCD (Charge-Coupled Device) 207. This data is processed as a digital signal. The processed data is transmitted to a remote location by a facsimile function or is printed by the image forming apparatus according to the example of the present invention. The data may be input into a computer so as to perform an image process.

The ADF 250 includes an original document table 251 on which a stack of the original documents is placed. The original document table 251 includes a movable plate 252. The left side portion of the original document table 251 in FIG. 18 is a sheet conveying section 253 of the ADF 250. In the sheet conveying section 253, a sheet feeding roller 254 disposed above a tip of the movable plate 252, a pair of separating rollers 255, a pair of conveying rollers 256 are disposed. Further, an image sensor, a conveying roller 257 arranged at a position opposed to the image sensor 258, a pressure plate 259, a conveying roller 260, and a pair of sheet discharging rollers 261 are provided. An original document discharging tray 262 is provided below the original document table 251. A space in which transfer sheets are discharged is formed between the original document table 251 and the original document discharging tray 262. A pressure plate 263 is arranged at the bottom of the original document discharging tray 262 such that the pressure plate 263 presses the original documents placed on the platen 202. A white sheet is affixed to the bottom surface of the pressure plate 263 (i.e., the surface faces the platen 202). The ADF is opened together with the pressure plate 263 in a direction separating from the platens 202 and 203. The pressure plate 263 is configured to press the original document even if a thick original document, such as a book, is placed on the platen 202. It is convenient to use the ADF 250 when the original document is sheet-formed.

A plurality of sheet-like original documents are placed on the movable plate 252 of the original document table 251 with a first page of the plurality of the sheet-like original documents face up. The sheet feeding roller 254 rotates in a direction indicated by an arrow (i.e., in a clockwise direction) to feed and convey the uppermost original document to the sheet conveying section 253. The original document is conveyed sheet-by-sheet by the pair of separating rollers 255. The original document is discharged in a direction indicated by an arrow in FIG. 18 from the pair of sheet discharging rollers 261 via the pair of conveying rollers 256, and conveying rollers 257 and 260. The discharged original documents are stacked on the original document.

An image on a second page of the original document is read by the image sensor 258. An image on a first page of the original document is read by the original image reading device 200 while the original document is conveyed through a space formed between the pressure plate 259 and the platen 203. When the image of the original document is read while the original document is conveyed through the space formed between the pressure plate 259 and the platen 203, the first and second carriages stay at respective image reading positions.

Namely, when the sheet-like original document is fed by the ADF 250, images formed on both surfaces of the sheet-like original document are read at two differently arranged image reading positions. An original image reading section while the original document is conveyed is referred to as "Y1". An original image reading section while the original document is fixed and read by the carriages 204 and 205 is referred to as "Y2".

In FIG. 18, the image sensor 258 in the ADF 250 is marked with the reference numeral Y1. Y2 is marked in the original image reading device 200. Y2 serves as a part of Y1 when reading the original image while conveying the original document by ADF 250. Namely, Y1 includes the image sensor 258 in the ADF 250 and a part of Y2.

When an original document is thin, a color of a pressure plate may be read through the original document as a background by an image reading device. Thus, a white sheet is affixed to the surface of the pressure plate 263 that faces the original document. For the same reason as described above, the conveying roller 257 and pressure plate 259 are made to be white.

Figure 20:
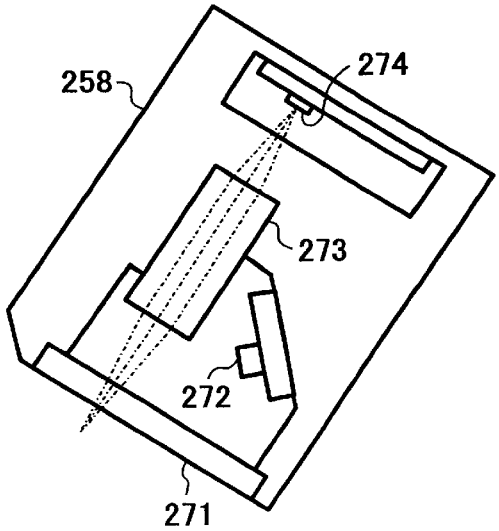
FIG. 20 is a diagram illustrating a sectional view of an image sensor.

FIG. 20 is a diagram illustrating a sectional view of the image sensor 258. The image sensor 258 includes a glass 271 that faces an original document, a light source to irradiate the original document, such as a LED array 272, a lens array 273 that is an image focusing member, and a same size magnification sensor 274. Another type of image sensor, for example a contact-type image sensor in which a focusing lens is not used, may be employed.

In the ADF 250 illustrated in FIG. 18, when a thick book is placed in the original image reading section Y2 as an original document, the original document is pressed by the pressure plate 263. However, the original image reading section Y1, which is integrally constructed with the ADF 250, is slightly lifted. Thus, the pressure plate 259 is separated from the platen 203. A sensor (not shown) to detect that the pressure plate 259 is separated from the platen 203 is provided. Based on the detection result of the sensor, use of the original image reading section Y1 is prohibited.

When an image forming operation is urgently required while an image of a sheet-like original document is read in the original image reading section Y1, the original image reading section Y2, in which the platen 202 and pressure plate 263 are used, is used for an interruption work, even if the sheet-like original document exists on the original document table 251 or on the original document discharging tray 262. The interruption work is designated by pressing a key in the operation panel OP (see FIG. 16).

Figure 21:
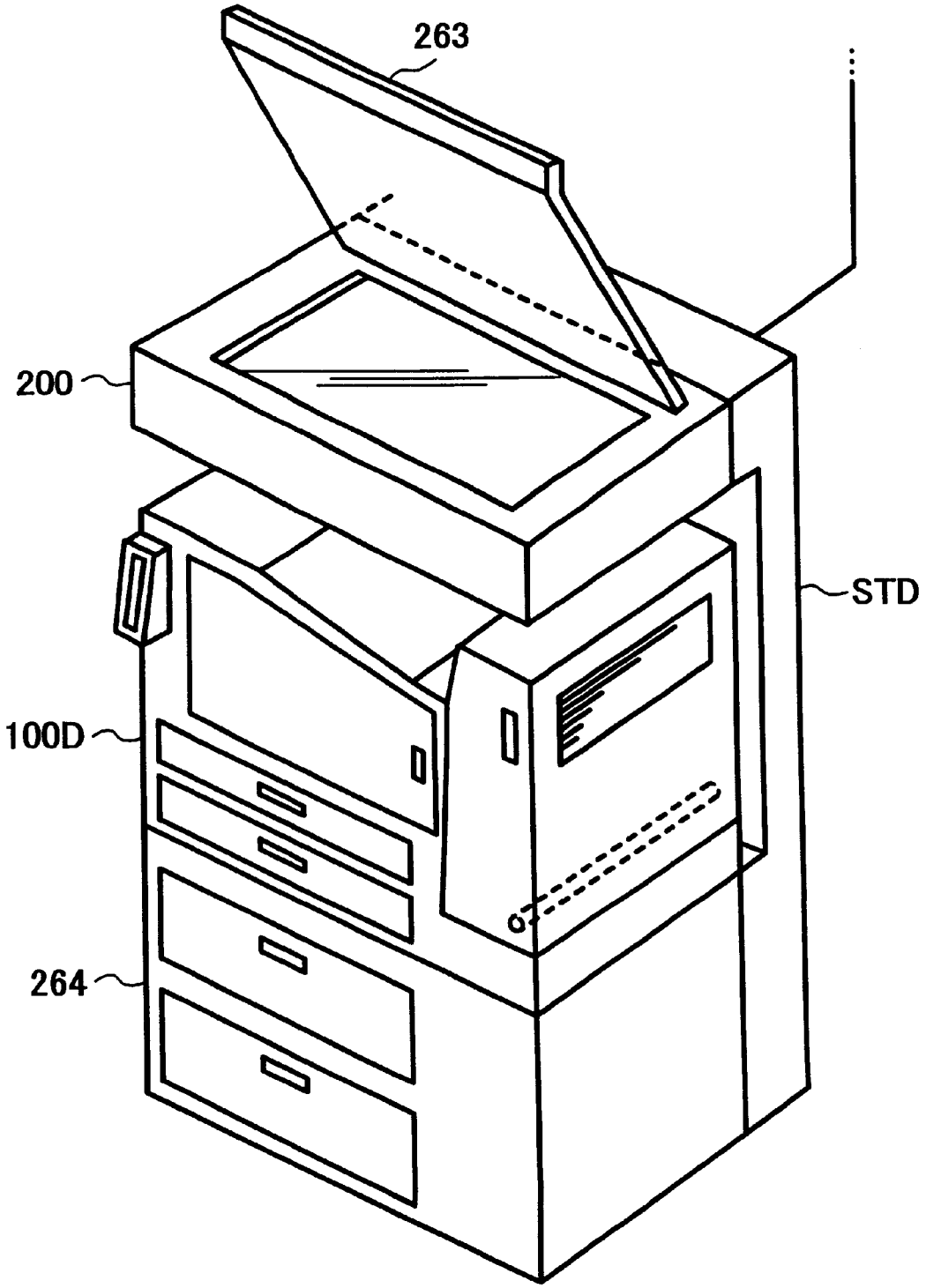
FIG. 21 is a perspective view illustrating an optional sheet feeding device and an original image reading device installed to the printer illustrated in FIG. 12 or FIG. 14.

FIG. 21 is a perspective view illustrating an optional sheet feeding device 264 and the original image reading device 200 are installed to the printer 100D. In FIG. 21, the pressure plate 263 of the original image reading device 200 is opened.

Figure 22:
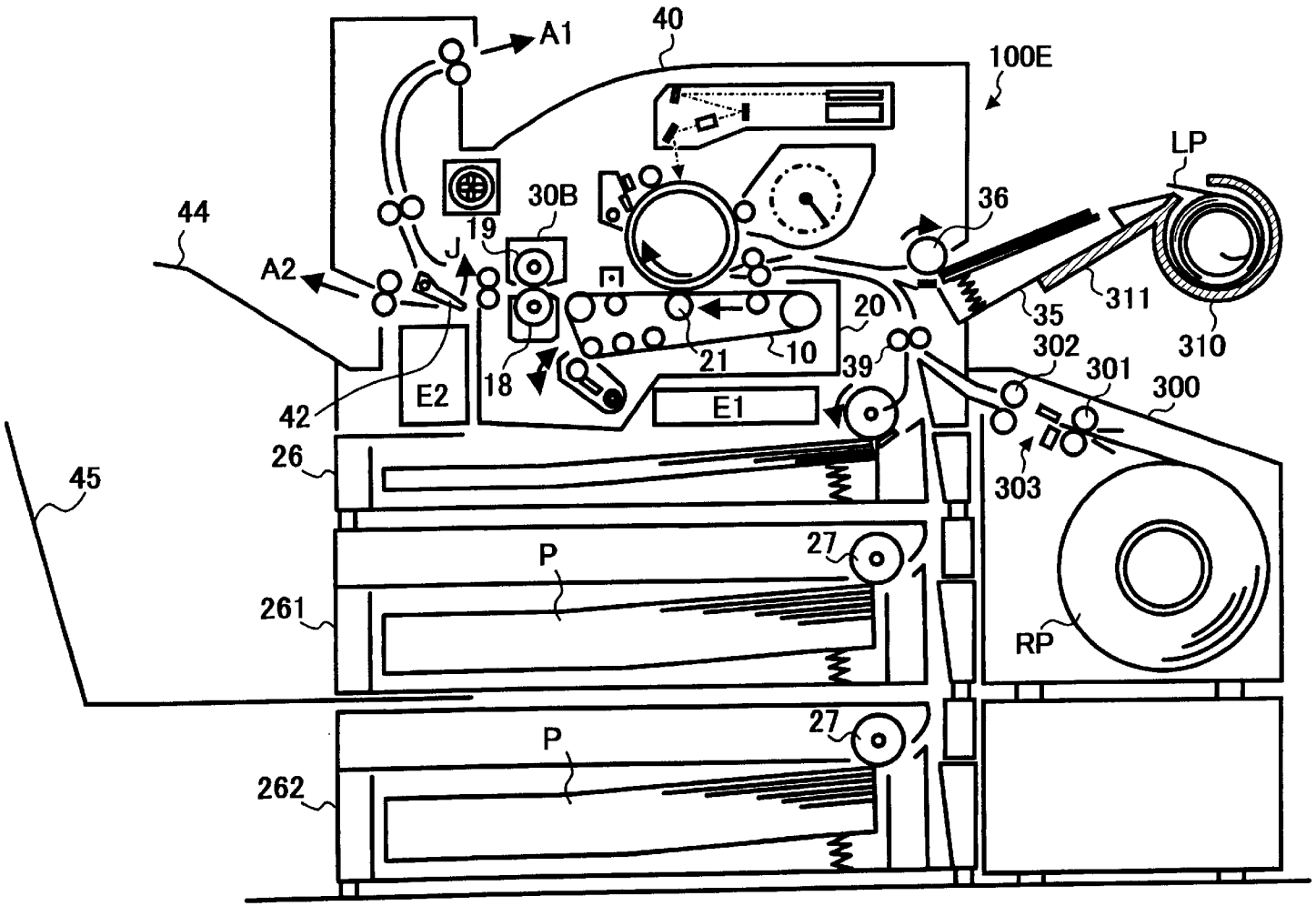
FIG. 22 is a schematic drawing illustrating another example of the printer.

FIG. 22 is a schematic drawing illustrating another example of a printer. According to this example, the printer 100E includes an optional sheet feeding device for a long transfer sheet. Because the basic construction of the printer 100E is similar to that of the printer 100 illustrated in FIG. 1, the devices that are different from those of the printer 100 are described below.

As illustrated in FIG. 22 sheet feeding cassettes 261 and 262 are vertically arranged at a lower portion of a main body of the printer 100E. A rolled sheet feeding device 300 is provided to the sides of the main body of the printer 100E and the sheet feeding cassettes 261 and 262. Further, a long transfer sheet holder 310 is provided to the manual sheet feeding device 35. A long transfer sheet exit tray 45 is provided to the opposite side of the sheet feeding cassettes 261 and 262 where the rolled sheet feeding device 300 is provided. The long transfer sheet exit tray 45 is slid into or out of the space provided between the sheet feeding cassettes 261 and 262.

The sheet feeding trays 261 and 262 are provided to feed an increased number of transfer sheets in a plurality of sizes while containing a normal-sized transfer sheet (i.e., transfer sheet not larger than A-3 size).

The long transfer sheet holder 310 holds a long transfer sheet LP while rolling it and feeds the long transfer sheet LP. The long transfer sheet LP is manually rolled and placed into the long transfer sheet holder 310. A tip portion of the long transfer sheet LP is reeled out from an outlet provided at an upper portion of the long transfer sheet holder 310 so that a leading edge of the long transfer sheet LP is caught by the sheet feeding roller 36. The long transfer sheet holder 310 is installed to a holder mounting part 311 of the manual sheet feeding device 35.

The rolled sheet feeding device 300 contains a rolled transfer sheet RP such that the rolled transfer sheet RP is reeled out. The rolled transfer sheet RP is conveyed to the main body of the printer 100E by pairs of sheet conveying rollers 301 and 302. The rolled transfer sheet RP is then cut to a predetermined length by a cutter 303. The rolled transfer sheet RP cut to the predetermined length is conveyed to the pair of registration rollers 38 by a pair of sheet conveying rollers 39.

The long transfer sheet holder 310 and the rolled sheet feeding device 300 can be installed as an optional device, thereby reducing an economic burden of a user who does not require these optional devices. The user can minimize an initial cost required for obtaining the apparatus because these optional devices can be separately obtained when these devices are required. The long transfer sheet holder 310 and the rolled sheet feeding device 300 can be installed to the printer 100 illustrated in FIG. 1 as an optional device.

Because an image forming process is performed in a similar manner to that described referring FIGS. 5A–5D, that explanation is omitted.

When an image is printed on a long transfer sheet, which is longer than the circumferential length of the intermediate transfer belt 10, a faulty image is produced if a both-surfaces printing is selected, because the second image bearing member can not carry the whole image to be printed onto such a long transfer sheet. Thus, the printer 100E is configured such that the both-surfaces printing is prohibited when the long transfer sheet is used. An image, which is longer than the circumferential length of the intermediate transfer belt 10, can not be printed even if a one-surface printing is performed, when the image is printed on the underside of the long transfer sheet (i.e., the surface of the long transfer sheet on the side of the intermediate transfer belt 10). Thus, the printer 100E is configured such that the one-surface printing on the surface of the transfer sheet, which is on the side of the intermediate transfer belt 10, is prohibited when the long transfer sheet is used.

However, an image formed on the surface of the photoconductive drum 1 (i.e., first image bearing member) can be directly transferred onto the long transfer sheet. Thus, the printer 100E is configured such that the image is transferred onto the surface of the transfer sheet that is on the side of the photoconductive drum 1, when the long transfer sheet is used.

When the long transfer sheet is used, an amount of heat supplied by a fixing device tends to be insufficient, even if the one-surface printing is performed. Therefore, fixing performance is decreased along a portion of the long transfer sheet i.e., from a leading portion to a trailing portion of the long transfer sheet. Thus, according to the example of the present invention, when the long transfer sheet is used, a fixing temperature is set at a higher level compared to that when a normal transfer sheet is used. In the printer 100E, the largest normal transfer sheet is A-3 size. Thus, a transfer sheet having a length greater than that of the A-3 sized transfer sheet is referred to as the long transfer sheet in this example. Other maximum sheet sizes may be used as a threshold size as well.

Figure 23A:
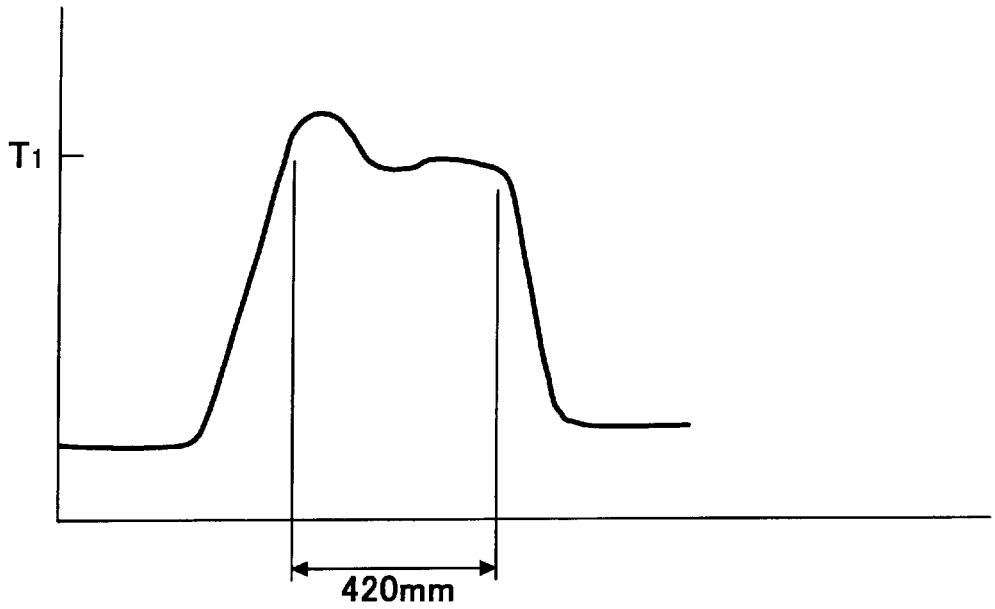
FIGS. 23A and 23B are diagrams illustrating a change in a fixing temperature when normal and long transfer sheets are used, respectively.
Figure 23B:
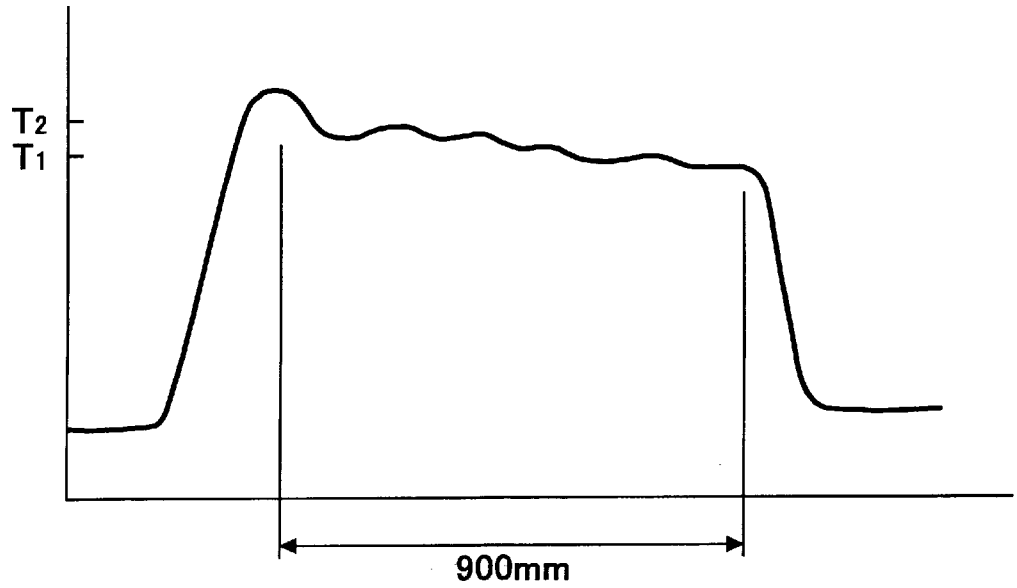

FIGS. 23A and 23B are diagrams illustrating a change in the fixing temperature when the normal and long transfer sheets are used, respectively. An A-3 sized transfer sheet (i.e., 420 mm in length) and a long transfer sheet (i.e., 900 mm in length) are used in FIGS. 23A and 23B, respectively. In the diagrams, the y-axis and the x-axis represent a temperature and a period of time in which a transfer sheet is conveyed through the fixing device, respectively.

In FIG. 23A, "T1" is a fixing temperature set when the normal transfer sheet is used. The temperature of the fixing device (i.e., fixing roller) is increased to a level that is higher than the set temperature of "T1" before the transfer sheet is conveyed to a fixing region. The temperature then decreases to the set temperature. An energization of a fixing heater is controlled to maintain the set temperature, when the temperature of the fixing device decreases because the heat is absorbed by the transfer sheet that passes through the fixing region. When the transfer sheet has passed through the fixing region, the energization of the fixing heater is stopped. Then, the temperature of the fixing device decreases.

In FIG. 23B, "T2" is a fixing temperature set when the long transfer sheet is used. "T2" is higher than "T1" (i.e., T1<T2). The long transfer sheet of 900 mm in length, which is far longer than the circumferential length of the intermediate transfer belt 10, is used. Because "T2" is set at a temperature higher than that of "T1" by about 10% to 30%, the decrease of the temperature of the fixing device is suppressed while the long transfer sheet passes through the fixing region, thereby preventing a faulty fixing.

An operation for recording an image on the long transfer sheet is described below referring to FIG. 22. When the long transfer sheet LP is used, the tip portion of the long transfer sheet LP is reeled out from the long transfer sheet holder 310 so that the leading edge of the long transfer sheet LP is caught by the sheet feeding roller 36.

When the rolled transfer sheet RP is used, a sheet feeding instruction is provided via the operation panel 50 (or the host computer HC). The rolled transfer sheet RP is then reeled out by a rotation of the pair of sheet conveying rollers 301. When the rolled transfer sheet RP is conveyed by a predetermined length by the pair of sheet conveying rollers 302, the rolled transfer sheet RP is cut by the cutter 303. The length of the rolled transfer sheet RP can be designated via the operation panel 50 or the host computer HC.

A toner image formed on the surface of the photoconductive drum 1 is directly transferred onto the long transfer sheet LP or the rolled transfer sheet RL, which is cut into the predetermined length, by the first transfer device 21 (hereinafter the long transfer sheet LP and the cut rolled transfer sheet RP are collectively referred to as a long transfer sheet). The toner image is fixed onto the long transfer sheet by the fixing device 30B. The long transfer sheet is then discharged to the long transfer sheet exit tray 45. At this time, the switching pick 42 is switched to the direction indicated by the arrow "J". The long transfer sheet conveyed in the direction indicated by the arrow "A2" is discharged to the long transfer sheet exit tray 45 via the exit tray 44. In this case, the discharged long transfer sheets are not collated by page. The long transfer sheet exit tray 45 is slid into the space formed between the sheet feeding cassettes 261 and 262 when the tray is not used, thereby saving space required for the printer 100E.

When the long transfer sheet is used in the printer 100C illustrated in FIG. 6, a both-surfaces printing and a one-surface printing on a surface of the long transfer sheet, which is on the side of the intermediate transfer belt 10, are prohibited. An image is transferred onto the surface of the long transfer sheet that is on the side of the photoconductive drum 1. The fixing temperature is set at a higher level when the long transfer sheet is used compared to that set when the normal transfer sheet is used. Thus, an occurrence of a faulty fixing is prevented when the long transfer sheet is used.

In the printer illustrated in FIG. 6, the long transfer sheet can be fed from the manual sheet feeding device 35. In addition, the long transfer sheet holder 310 and the rolled sheet feeding device 300 can be installed to this printer as in the printer 100E illustrated in FIG. 22.

Because an image forming process is performed in a similar manner to that described referring to FIGS. 7A–7D, that explanation is omitted.

Figure 24:
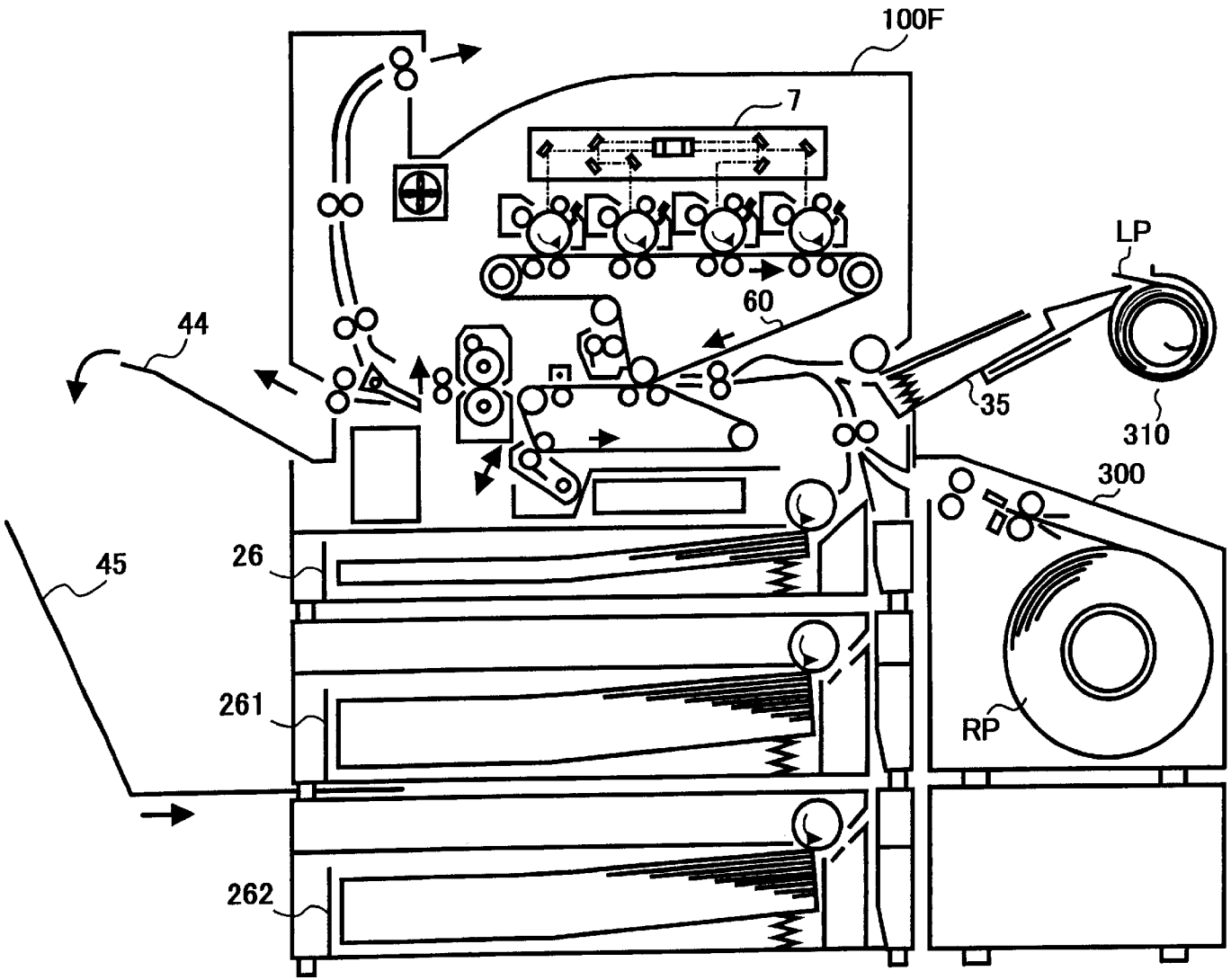
FIG. 24 is a schematic drawing illustrating another example of a full color image forming apparatus.

FIG. 24 is a schematic drawing illustrating another example of a full color image forming apparatus in which an optional device for a long transfer sheet is installed. The construction of the image forming section is similar to that of the image forming apparatus illustrated in FIG. 8. As is the case with the example illustrated in FIG. 22, the sheet feeding cassettes 26, 261, and 262 are provided in a lower portion of the apparatus. The rolled sheet feeding device 300 is provided to the right side of the apparatus. The long transfer sheet holder 310 is provided to the manual sheet feeding device 35. Further, the long transfer sheet exit tray 45 is provided to the left side of the apparatus. The long transfer sheet exit tray 45 is slid into or out of the space provided between the sheet feeding trays 261 and 262.

The fixing device 30B is arranged on the left side of the intermediate transfer member 110 similar to the example illustrated in FIG. 22.

According to the example of the present invention, a toner image formed in the image forming section PU is carried by the intermediate transfer belt 60. The toner image is then transferred onto the intermediate transfer member 110 or one surface of a transfer sheet that is conveyed by the pair of registration rollers 28. The transfer sheet is fed by each sheet feeding cassette 26, 261, and 262, the manual sheet feeding device 35, or the rolled sheet feeding device 300, and is conveyed to the pair of the registration rollers 28. The transfer sheet used in the example includes a normal sheet-like transfer sheet that is fed by the sheet feeding cassettes 26, 261, and 262, a thick and rigid transfer sheet, such as a cardboard, an envelope, etc. that is fed by the manual sheet feeding device 35, and a long transfer sheet that is fed by the rolled sheet feeding device 300.

Figure 8:
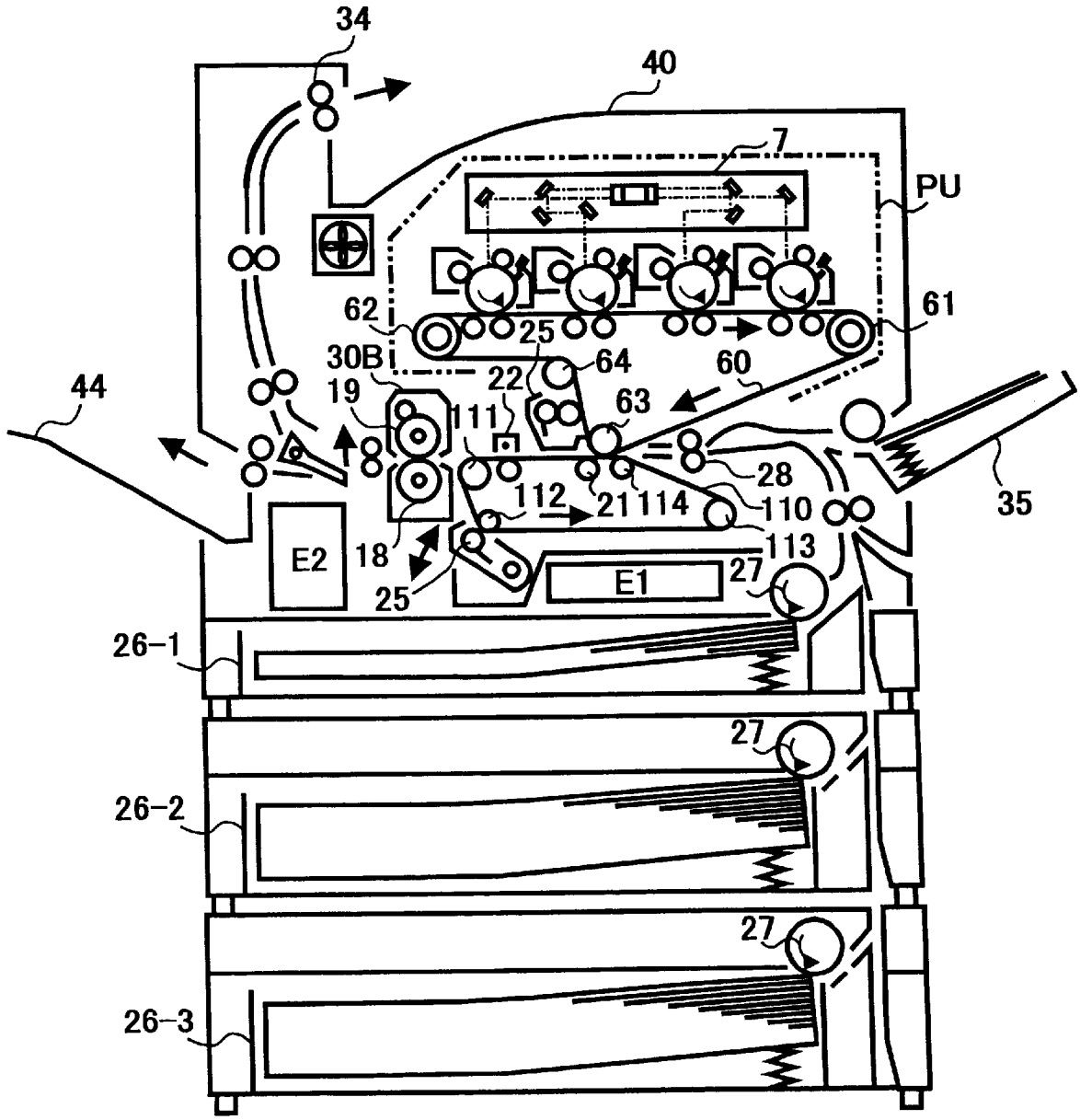
FIG. 8 is a schematic drawing illustrating a sectional view of a printer as an example of a full color image forming apparatus.

A both-surfaces printing is performed in a similar manner as in the image forming apparatus illustrated in FIG. 8.

When an image is printed on a long transfer sheet, which is longer than the circumferential length of the intermediate transfer belt 10, a faulty image is produced if a both-surfaces printing is selected, because the second image bearing member can not carry the whole image to be printed onto such a long transfer sheet. Thus, a printer 100F is configured such that the both-surfaces printing is prohibited when the long transfer sheet is used. An image, which is longer than the circumferential length of the intermediate transfer belt 10, can not be printed even if a one-surface printing is performed, when the image is printed on the underside of the long transfer sheet (i.e., the surface of the long transfer sheet on the side of the intermediate transfer belt 10). Thus, the printer 100F is configured such that the one-surface printing on the surface of the transfer sheet, which is on the side of the intermediate transfer belt 10, is prohibited when the long transfer sheet is used.

However, an image formed on the surface of the photoconductive drum 1 (i.e., first image bearing member) can be directly transferred onto the long transfer sheet. Thus, the printer 100F is configured such that the image is transferred onto the surface of the transfer sheet that is on the side of the photoconductive drum 1, when the long transfer sheet is used.

When the long transfer sheet is used, an amount of heat supplied by a fixing device tends to be insufficient, even if the one-surface printing is performed. Therefore, fixing performance is decreased along a portion of the long transfer sheet i.e., from a leading portion to a trailing portion of the long transfer sheet. Thus, according to the example of the present invention, when the long transfer sheet is used, a fixing temperature is increased by about 10% to 30% compared to that when a normal transfer sheet is used. A transfer sheet that is larger than A-3 size is referred to as the long transfer sheet in this example. Other maximum sheet sizes may be used as a threshold size as well.

According to the above-described examples, a toner image transferred onto the second image bearing member, i.e., the intermediate transfer belt 10 or intermediate transfer member 110, is circled while being carried by the intermediate transfer belt 10 or intermediate transfer member 110 before the toner image is transferred onto a transfer sheet. Thus, a similar period of time is required to print an image irrespective of a size of the image because the corresponding toner image is circled while being carried by the second image bearing member. In other words, an extra period of time is spent for printing a small size image.

When the small size image (i.e., an image that is small in a sub-scanning direction) is printed, a plurality of the small size images are carried by the second image bearing member. The plurality of the small size images are then successively transferred onto a plurality of transfer sheets, thereby increasing efficiency and productivity. When the both-surfaces printing is performed, the images are successively transferred onto the other surface of the plurality of transfer sheets from the first image bearing member. In this case, the second image bearing member needs to have a size in which the plurality of the small size images are transferred.

For example, an A-3 size image is transferred onto the intermediate transfer belt 10 or the intermediate transfer member 110 in a vertical position. According to the examples of the present invention, the intermediate transfer belt 10 or the intermediate transfer member 110 carries two A-4 or B-5 size images in a horizontal position at one time. The intermediate transfer belt 10 or the intermediate transfer member 110 carries three or more images at one time if the images are small (e.g., a size of a business card). Thus, when a size of an image to be formed is small, images of a plurality of pages (i.e., "n" number of images) are successively formed. The images thus formed are transferred onto the intermediate transfer belt 10 or the intermediate transfer member 110 in sequence such that the intermediate transfer belt 10 or the intermediate transfer member 110 carries the plurality of images (i.e., "n" number of images). A plurality of transfer sheets (i.e., "n" number of transfer sheets) are successively fed so that the images are transferred onto the respective plurality of transfer sheets. When a both-surfaces printing is performed, the order of pages of the transfer sheet on which images are printed is different from that when a one-surface printing is performed. However, the change of the pages is accomplished by a commonly known technology in which image data is stored and read.

In this operation, a plurality of prints are performed by one turn of the intermediate transfer belt 10 or intermediate transfer member 110. The operation in which the second image bearing member bears a plurality of images and successively transfers the plurality of images onto a plurality of transfer sheets (hereinafter referred to as a successive small size print) is designated through an operation panel of the apparatus or a host computer. In the successive small size print operation, a transfer sheet is conveyed at different intervals from that when a normal size print operation is performed. Thus, when the successive small size print is designated, the time to form an image and to convey a transfer sheet is controlled based on the intervals that the transfer sheet is conveyed.

In the above-described examples of the present invention, the successive small size print can be performed when a size of a transfer sheet (i.e., a size of an image) is not larger than A-4 size in a horizontal position. Thus, an image transfer process is controlled such that the successive small size print is prohibited for the transfer sheet larger than A-4 size.

Figure 25A:
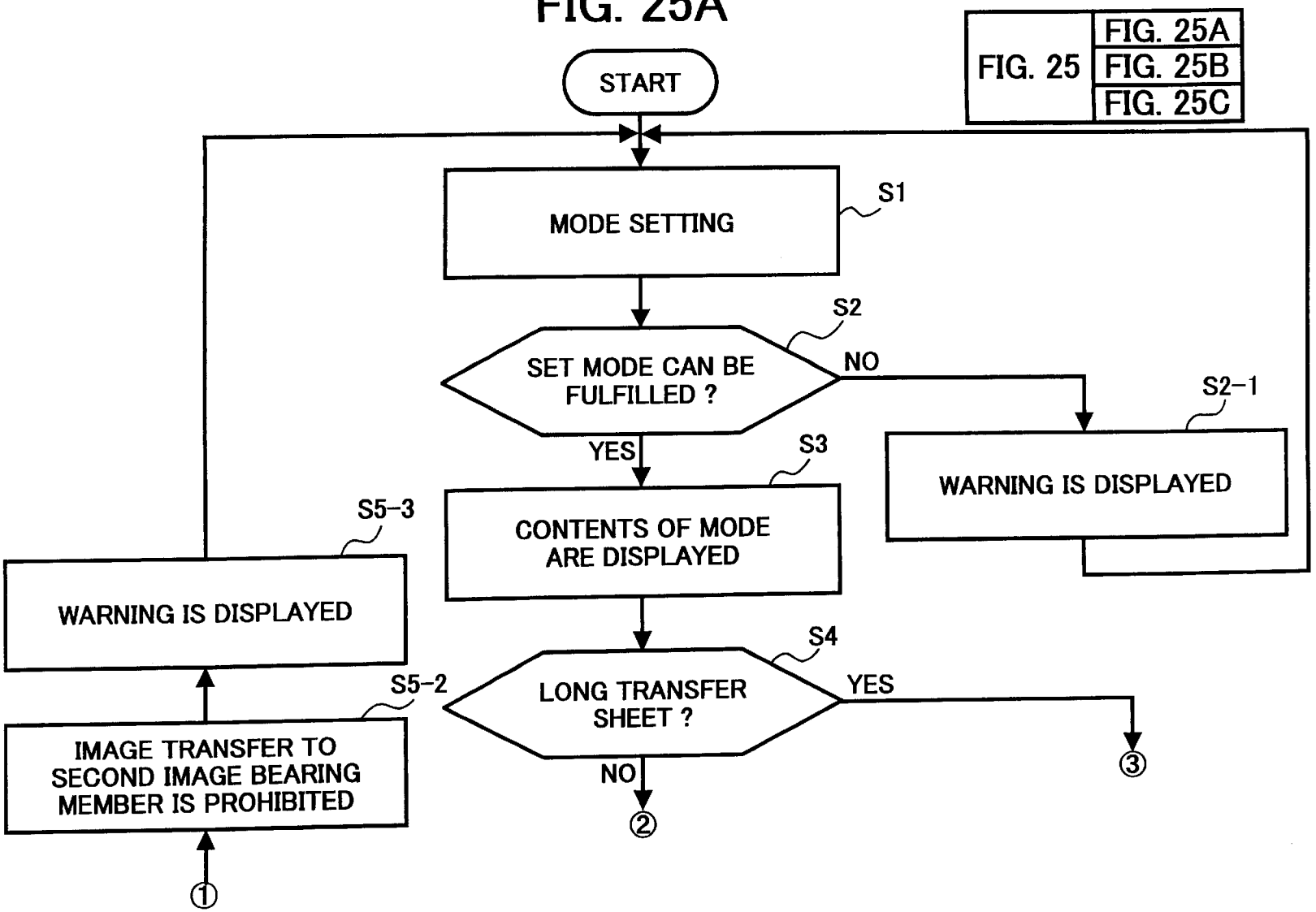
FIGS. 25A–25C are a flowchart illustrating a control of an image forming condition based on a length of the transfer sheet.
Figure 25B:
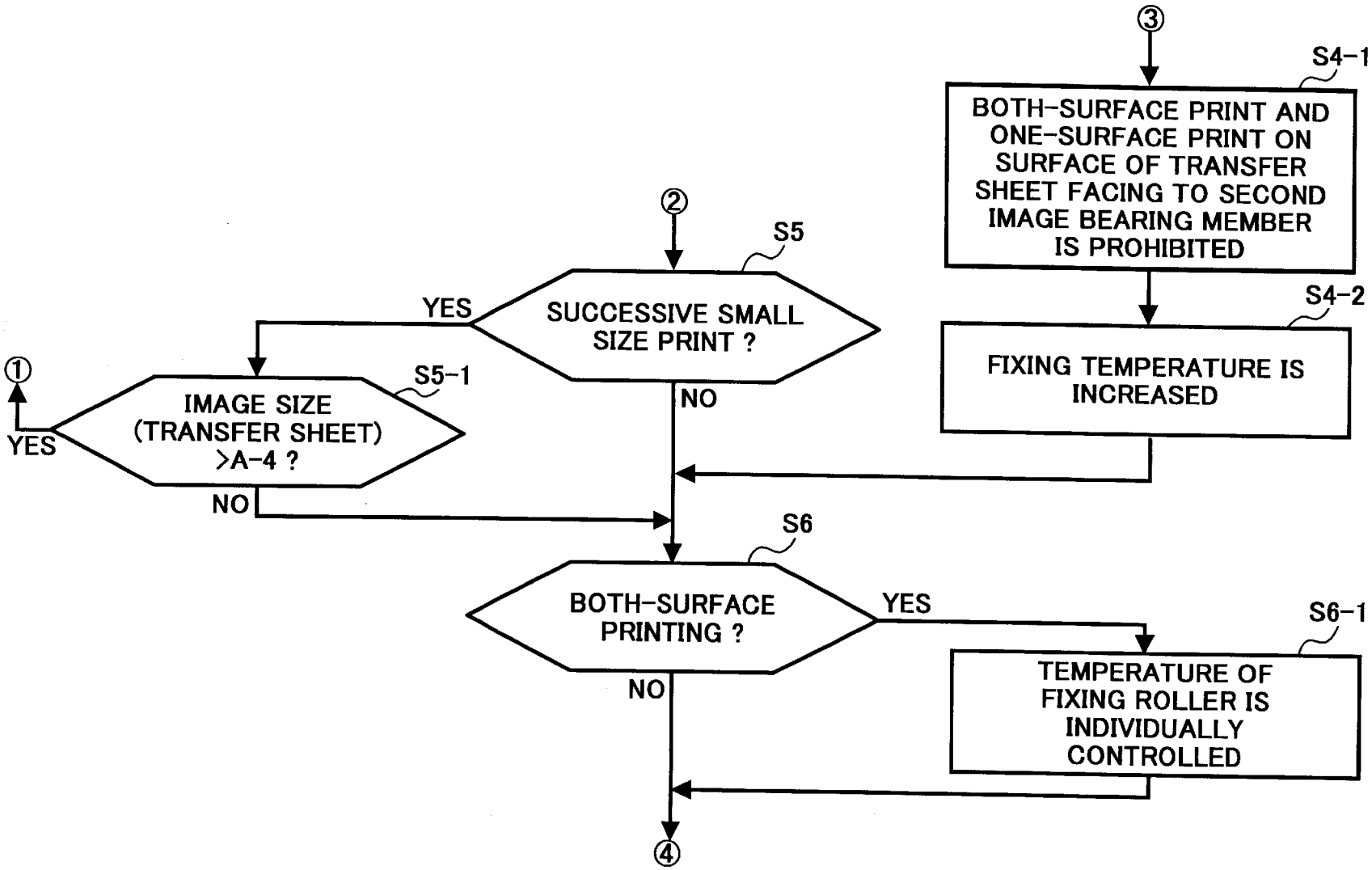
Figure 25C:
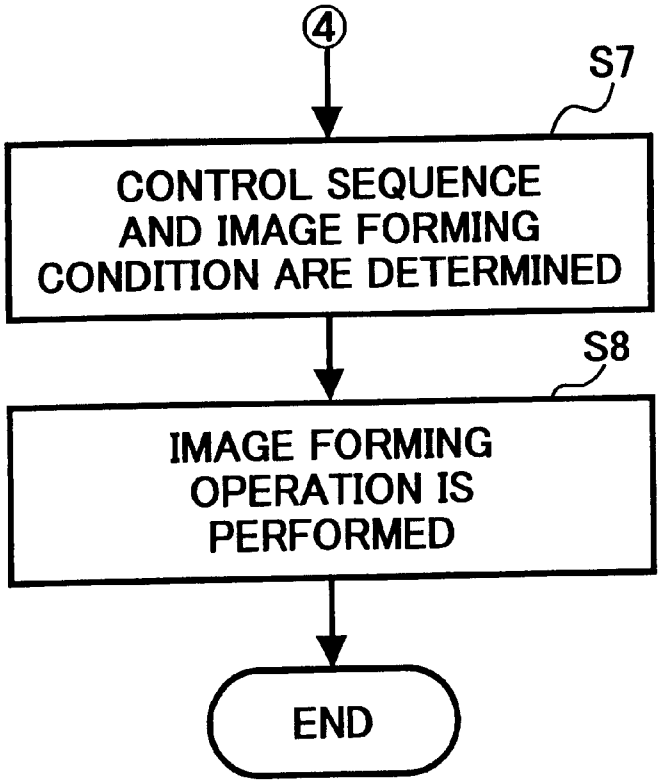

FIGS. 25A–25C are a flowchart illustrating the control of the image forming conditions when a long transfer sheet is used. Steps S1 to S3 are similar to those described in FIG. 10. At step S4, whether or not the long transfer sheet is used is determined. When the long transfer sheet is used (i.e. "Yes" in step S4), a transfer process is controlled such that a both-surfaces printing and one-surface printing on the surface of the transfer sheet facing to the second image bearing member are prohibited at step S4-1. A fixing temperature is increased by about 10% to 30% compared to that when a normal transfer sheet is used at step S4-2.

At step S5, whether or not a successive small size print is designated is determined. When the successive small size print is designated (i.e. "Yes" at step S5), whether or not a size of an image (i.e., a size of a transfer sheet) is larger than A-4 size in a horizontal position is determined at step S5-1. When the size of the image (i.e., the transfer sheet) is not larger than A-4 size (i.e. "No" at step S5-1), the process proceeds to step S6. When the size of the image (i.e., the transfer sheet) is larger than A-4 size (i.e. "Yes" at step S5-1), an image transfer operation onto the second image bearing member is prohibited at step S5-2. In addition, an alarm is displayed at step S5-3. The process proceeds to step S1 to set a mode. The process performed in steps S6 to S8 is similar to that performed in the steps S5 to S7 in FIG. 10.

While this invention is described in conjunction with the examples outlined above, it is evident that many alternatives, modifications, and variations will be apparent. For example, although the transfer devices 21 and 65 are configured to be a roller-type that contacts the intermediate transfer belt 10 (and 60) according to the above-described example, a transfer device in a brush-type or a roll-shaped brush-type may be used. Further, a discharge-type (i.e., a charger) that does not contact the intermediate transfer belt 10 (and 60) may be employed.

A belt-type image bearing member may be used instead of the photoconductive drum 1. Then, an appropriate charging device, a developing device, a fixing device, etc. may be adopted for the belt-type image bearing member. The configuration of the operation panel 50 (and OP) and an arrangement of setting button is not limited to the above-described examples. The fixing device 30, in which a fixing operation is performed while retaining a transfer sheet on the intermediate transfer belt 10, used in the printer 100 illustrated in FIG. 1 may be used in the printers 100B and 100C illustrated in FIGS. 4 and 6, respectively. Further, in the image forming apparatus illustrated in FIG. 8, a fixing operation may be performed while retaining a transfer sheet on the intermediate transfer member 110. The image forming apparatus includes a copying machine and a facsimile without limiting to a printer.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2000-328955, filed on Oct. 27, 2000, Japanese Patent Application No. 2000-330567, filed on Oct. 30, 2000, Japanese Patent Application No. 2001-305635, filed on Oct. 1, 2001, and Japanese Patent Application No. 2001-310057, filed on Oct. 5, 2001, and the entire contents of each of which are hereby incorporated herein by reference.

What is claimed is:

1. An image forming apparatus, comprising:

a first belt-formed image bearing member configured to transfer a first visible image onto a first surface of a recording medium; and a second belt-formed image bearing member configured to transfer a second visible image that has been transferred from said first image bearing member onto a second surface of the recording medium such that visible images are transferred onto both surfaces of the recording medium, wherein an image forming condition including a fixing condition is controlled differently depending on a specific property of a recording medium;

wherein the first and second belt-formed image bearing members are each intermediate transfer belts, and the second visible image is formed by a plurality of image forming units and is transferred onto the first belt-formed image bearing member while the first belt-formed image bearing member contacts the plurality of image forming units and then the first visible image is formed by the plurality of image forming units and is transferred onto the first belt-formed image bearing member.

2. The image forming apparatus according to claim 1, further comprising:

a first transfer device configured to transfer the first visible image from said first image bearing member onto one of said second image bearing member and the first surface of the recording medium; and a second transfer device configured to transfer the second visible image from said second image bearing member onto the second surface of the recording medium, wherein the visible images transferred onto the recording medium are fixed while the recording medium is placed in contact with said second image bearing member.

3. The image forming apparatus according to claim 1, wherein the first visible image is formed on a first surface of said first image bearing member and is transferred onto said second image bearing member and a polarity of the first image on said second image bearing member is reversed so that the first image and the second image formed on the first surface of said first image bearing member are transferred onto respective surfaces of the recording medium approximately at a same time.

4. The image forming apparatus according to claim 1, further comprising a contacting transfer device provided at a position opposed to said first image bearing member and configured to contact a non-image bearing surface of said second image bearing member.

5. The image forming apparatus according to claim 1, further comprising a sheet feeding device and a sheet discharging device configured such that a sheet conveying path between the sheet feeding device and the sheet discharging device is approximately straight.

6. The image forming apparatus according to claim 1, wherein the specific property of the recording medium includes a thickness of the recording medium.

7. The image forming apparatus according to claim 1, wherein the specific property of the recording medium includes the recording medium having a portion where the recording medium is folded into two.

8. The image forming apparatus according to claim 1, wherein the specific property of the recording medium includes a smoothness of the recording medium.

9. The image forming apparatus according to claim 1, wherein the image forming condition controlled for the recording medium having the specific property includes a transfer condition.

10. The image forming apparatus according to claim 9, wherein the controlled transfer condition includes an order of a transfer process.

11. The image forming apparatus according to claim 9, wherein the controlled transfer condition includes an output of a transfer bias applied to a transfer device in a visible image transfer process onto the recording medium.

12. The image forming apparatus according to claim 1, wherein the fixing condition controlled for the recording medium having the specific property includes a fixing temperature for fixing an image on the first and second surfaces of the recording medium.

13. The image forming apparatus according to claim 1, further comprising a plurality of sheet discharging devices in which respective printed recording mediums are collated by a different order of pages, wherein one of the plurality of sheet discharging devices is selected for the recording medium having the specific property.

14. The image forming apparatus according to claim 13, wherein the selection of the sheet discharging device includes the sheet discharging device in which a discharged printed recording medium is collated by page.

15. The image forming apparatus according to claim 13, wherein the selection of the sheet discharging device includes the sheet discharging device in which the recording medium is discharged without being reversed for the recording medium having the specific property.

16. The image forming apparatus according to claim 1, wherein said second image bearing member is formed as an endless belt and is extended close to a fixing region.

17. The image forming apparatus according to claim 1, further comprising a manual sheet feeding device, wherein when the recording medium is fed from the manual sheet feeding device, the recording medium is recognized as the recording medium having the specific property.

18. The image forming apparatus according to claim 1, wherein the recording medium having the specific property, for which the image forming condition including the fixing condition is controlled, is designated through an operation panel.

19. The image forming apparatus according to claim 1, wherein the recording medium having the specific property, for which the image forming condition including the fixing condition is controlled, is designated through an external apparatus connected to the image forming apparatus.

20. A method for forming an image, comprising:

transferring a first visible image from a first belt-formed image bearing member to a send belt-formed image bearing member;

transferring the first visible image transferred onto the second image bearing member onto a first surface of a recording medium;

transferring a second visible image from the first image bearing member onto a second surface of the recording medium to form visible images on both surfaces of the recording medium; and controlling an image forming condition including a fixing condition differently depending on a specific property of a recording medium, wherein the first and second belt-formed image bearing members are each intermediate transfer belts, and the second visible image is formed by a plurality of image forming units and is transferred onto the first belt-formed image bearing member while the first belt-formed image bearing member contacts the plurality of image forming units and then the first visible image is formed by the plurality of image forming units and is transferred onto the first belt-formed image bearing member.

21. A method for forming an image, comprising:

transferring a first visible image from a first image bearing member to a second image bearing member;

transferring the first visible image transferred onto the second image bearing member onto a first surface of a recording medium;

transferring a second visible image from the first image bearing member onto a second surface of the recording medium to form visible images on both surfaces of the recording medium;

fixing the first and second visible images transferred onto the recording medium while the recording medium is placed in contact with the second image bearing member; and controlling an image forming condition including a fixing condition differently depending on a specific property of a recording medium.

22. A method for forming an image, comprising:

transferring a first image formed on a first surface of a first belt-formed image bearing member to a second belt-formed image bearing member;

forming a second image on the first surface of the first image bearing member;

reversing a polarity of the first image transferred onto the second image bearing member;

transferring the first and second images onto respective surfaces of the recording medium at a same time; and controlling an image forming condition including a fixing condition differently depending on a specific property of a recording medium, wherein the first and second belt-formed image bearing members are each intermediate transfer belts, and the second visible image is formed by a plurality of image forming units and is transferred onto the first belt-formed image bearing member while the first belt-formed image bearing member contacts the plurality of image forming units and then the first visible image is formed by the plurality of image forming units and is transferred onto the first belt-formed image bearing member.

23. An image forming apparatus, comprising:

first belt-formed image bearing means for transferring a first visible image onto a first surface of a recording medium; and second belt-formed image bearing means for transferring a second visible image that has been transferred from the first image bearing means onto a second surface of the recording medium such that visible images are transferred onto both surfaces of the recording medium, wherein an image forming condition including a fixing condition is controlled differently depending on a specific property of a recording medium;

wherein the first and second belt-formed image bearing means are each intermediate transfer belts, and the second visible image is formed by a plurality of image forming means and is transferred onto the first belt-formed image bearing means while the first belt-formed image bearing means contacts the plurality of image forming means and then the first visible image is formed by the plurality of image forming means and is transferred onto the first belt-formed image bearing means.

24. The image forming apparatus according to claim 23, further comprising:

first transfer means for transferring the first visible image from the first image bearing means onto one of the second image bearing means and the first surface of the recording medium; and second transfer means for transferring the second visible image from the second image bearing means onto the second surface of the recording medium, wherein the visible images transferred onto the recording medium are fixed while the recording medium is placed in contact with the second image bearing means.

25. The image forming apparatus according to claim 23, wherein the first visible image is formed on a first surface of the first image bearing means and is transferred onto the second image bearing means and a polarity of the first image on the second image bearing means is reversed so that the first image and the second image formed on the surface of the first image bearing means are transferred onto respective surfaces of the recording medium approximately at a same time.

26. The image forming apparatus according to claim 23, further comprising contacting transfer means provided at a position opposed to the first image bearing means for contacting a non-image bearing surface of the second image bearing means.

27. The image forming apparatus according to claim 23, further comprising sheet feeding means and sheet discharging means arranged such that a sheet conveying path between the sheet feeding means and the sheet discharging means is approximately straight.

28. The image forming apparatus according to claim 23, wherein the specific property of the recording medium includes a thickness of the recording medium.

29. The image forming apparatus according to claim 23, wherein the specific property of the recording medium includes the recording medium having a portion where the recording medium is folded into two.

30. The image forming apparatus according to claim 23, wherein the specific property of the recording medium includes a smoothness of the recording medium.

31. The image forming apparatus according to claim 23, wherein the image forming condition controlled for the recording medium having the specific property includes a transfer condition.

32. The image forming apparatus according to claim 31, wherein the controlled transfer condition includes an order of a transfer process.

33. The image forming apparatus according to claim 31, wherein the controlled transfer condition includes an output of a transfer bias applied to a transfer device in a visible image transfer process onto the recording medium.

34. The image forming apparatus according to claim 23, wherein the fixing condition controlled for the recording medium having the specific property includes a fixing temperature for fixing an image on the first and second surfaces of the recording medium.

35. The image forming apparatus according to claim 23, further comprising a plurality of sheet discharging means for collating respective printed recording mediums by a different order of pages, wherein one of the plurality of sheet discharging means is selected for the recording medium having the specific property.

36. The image forming apparatus according to claim 35, wherein the selection of the sheet discharging means includes the sheet discharging means in which a discharged printed recording medium is collated by page.

37. The image forming apparatus according to claim 35, wherein the selection of the sheet discharging means includes the sheet discharging means in which the recording medium is discharged without being reversed for the recording medium having the specific property.

38. The image forming apparatus according to claim 23, wherein said second image bearing means is formed as an endless belt and is extended close to a fixing region.

39. The image forming apparatus according to claim 23, further comprising manual sheet feeding means, wherein when the recording medium is fed from the manual sheet feeding means, the recording medium is recognized as the recording medium having the specific property.

40. The image forming apparatus according to claim 23, wherein the recording medium having the specific property, for which the image forming condition including the fixing condition is controlled, is designated through an operation panel.

41. The image forming apparatus according to claim 23, wherein the recording medium having the specific property, for which the image forming condition including the fixing condition is controlled, is designated through an external apparatus connected to the image forming apparatus.

42. An image forming apparatus, comprising:

a first belt-formed image bearing member configured to transfer a first visible image onto a first surface of a recording medium;

a second belt-formed image bearing member configured to transfer a second visible image that has been transferred from said first image bearing member onto a second surface of the recording medium such that visible images are transferred onto both surfaces of the recording medium, wherein an image forming condition is controlled based on a length of the recording medium and depending on a circumferential length of said second image bearing member;

wherein the first and second belt-formed image bearing members are each intermediate transfer belts, and the second visible image is formed by a plurality of image forming units and is transferred onto the first belt-formed image bearing member while the first belt-formed image bearing member contacts the plurality of image forming units and then the first visible image is formed by the plurality of image forming units and is transferred onto the first belt-formed image bearing member.

43. The image forming apparatus according to claim 42, further comprising:

a first transfer device configured to transfer the first visible image from said first image bearing member onto one of said second image bearing member and the first surface of the recording medium; and a second transfer device configured to transfer the second visible image from said second image bearing member onto the second surface of the recording medium, wherein the visible images transferred onto the recording medium are fixed while the recording medium is placed in contact with said second image bearing member.

44. The image forming apparatus according to claim 42, wherein the first visible image is formed on a first surface of said first image bearing member and is transferred onto said second image bearing member and a polarity of the first image on said second image bearing member is reversed so that the first image and the second image formed on the first surface of said first image bearing member are transferred onto respective surfaces of the recording medium approximately at a same time.

45. The image forming apparatus according to claim 42, wherein a plurality of images are transferred onto said second image bearing member, and the plurality of images are transferred one after another onto a plurality of successively conveyed recording mediums.

46. The image forming apparatus according to claim 42, wherein the image forming condition is controlled differently when the length of the recording medium exceeds the circumferential length of said second image bearing member.

47. The image forming apparatus according to claim 46, further comprising a plurality of sheet feeding devices, wherein at least one of the plurality of sheet feeding devices is configured to feed a recording medium longer than the circumferential length of said second image bearing member.

48. The image forming apparatus according to claim 47, wherein the sheet feeding device configured to feed the recording medium longer than the circumferential length of said second image bearing member includes a long recording medium holder containing a sheet-like recording medium that is longer than the circumferential length of said second image bearing member.

49. The image forming apparatus according to claim 48, wherein the sheet feeding device configured to feed the recording medium longer than the circumferential length of said second image bearing member includes a rolled sheet feeding device that contains and feeds a rolled recording medium.

50. The image forming apparatus according to claim 49, wherein one of the long recording medium holder and the rolled sheet feeding device is attachable and detachable to a main body of the image forming apparatus.

51. The image forming apparatus according to claim 42, wherein the controlled image forming condition includes a transfer condition.

52. The image forming apparatus according to claim 51, wherein an image transfer onto both-surfaces of the recording medium is prohibited when the recording medium is longer than the circumferential length of said second image bearing member.

53. The image forming apparatus according to claim 51, wherein an image transfer onto said second image bearing member from said first image bearing member is prohibited when the recording medium is longer than the circumferential length of said second image bearing member.

54. The image forming apparatus according to claim 42, wherein the controlled image forming condition includes a fixing condition.

55. The image forming apparatus according to claim 54, wherein a fixing temperature is increased compared to a fixing temperature set for a normal recording medium when the recording medium is longer than the circumferential length of said second image bearing member.

56. The image forming apparatus according to claim 42, wherein said second image bearing member is formed as an endless belt and is extended close to a fixing region.

57. The image forming apparatus according to claim 42, further comprising a long recording medium exit tray.

58. The image forming apparatus according to claim 57, wherein the long recording medium exit tray is provided below an exit tray for a normal recording medium.

59. The image forming apparatus according to claim 58, wherein a part of the long recording medium exit tray is contained in a main body of the image forming apparatus.

60. The image forming apparatus according to claim 57, wherein a part of the long recording medium exit tray is contained in a main body of the image forming apparatus.

61. The image forming apparatus according to claim 57, wherein a sheet conveying path is switched such that a recording medium that is equal to or longer than a predetermined length is discharged to the long recording medium exit tray when an image is formed on the recording medium that is equal to or longer than the predetermined length.

62. The image forming apparatus according to claim 42, wherein a length of the recording medium, for which the image forming condition is controlled, is designated through an operation panel.

63. The image forming apparatus according to claim 42, wherein a length of the recording medium, for which the image forming condition is controlled, is designated through an external apparatus connected to the image forming apparatus.

64. A method for forming an image, comprising:

transferring a first visible image from a first belt-formed image bearing member onto a second belt-formed image bearing member;

transferring the first visible image transferred onto the second image bearing member onto a first surface of a recording medium;

transferring a second visible image from the first image bearing member onto the second surface of the recording medium to form visible images on both surfaces of the recording medium; and controlling an image forming condition based on a length of the recording medium, wherein the first and second belt-formed image bearing members are each intermediate transfer belts, and the second visible image is formed by a plurality of image forming units and is transferred onto the first belt-formed image bearing member while the first belt-formed image bearing member contacts the plurality of image forming units and then the first visible image is formed by the plurality of image forming units and is transferred onto the first belt-formed image bearing member.

65. A method for forming an image, comprising:

transferring a first visible image from a first image bearing member onto a second image bearing member;

transferring the first visible image transferred onto the second image bearing member onto a first surface of a recording medium;

transferring a second visible image from the first image bearing member onto the second surface of the recording medium to form visible images on both surfaces of the recording medium;

fixing the visible images transferred onto the recording medium while the recording medium is placed on the second image bearing member; and controlling an image forming condition based on a length of the recording medium.

66. A method for forming an image, comprising:

transferring a first image formed on a first surface of a first belt-formed image bearing member onto a second belt-formed image bearing member;

forming a second image on the first surface of the first image bearing member;

reversing a polarity of the first image transferring onto the second image bearing member;

transferring the first and second images onto respective surfaces of a recording medium at a same time; and controlling an image forming condition based on a length of the recording medium, wherein the first and second belt-formed image bearing members are each intermediate transfer belts, and the second visible image is formed by a plurality of image forming units and is transferred onto the first belt-formed image bearing member while the first belt-formed image bearing member contacts the plurality of image forming units and then the first visible image is formed by the plurality of image forming units and is transferred onto the first belt-formed image bearing member.

67. An image forming apparatus, comprising:

first belt-formed image bearing means for transferring a first visible image onto a first surface of a recording medium;

second belt-formed image bearing means for transferring a second visible image that has been transferred from the first image bearing means onto the second surface of the recording medium such that visible images are transferred onto both surfaces of the recording medium, wherein an image forming condition is controlled based on a length of the recording medium, and the length of the recording medium is based on a circumferential length of the second image bearing means;

wherein the first and second belt-formed image bearing means are each intermediate transfer belts, and the second visible image is formed by a plurality of image forming means and is transferred onto the first belt-formed image bearing means while the first belt-formed image bearing means contacts the plurality of image forming means and then the first visible image is formed by the plurality of image forming means and is transferred onto the first belt-formed image bearing means.

68. The image forming apparatus according to claim 67, further comprising:

first transfer means for transferring the first visible image from the first image bearing means onto one of the second image bearing means and the first surface of the recording medium; and second transfer means for transferring the second visible image from the second image bearing means onto the second surface of the recording medium, wherein the visible images transferred onto the recording medium are fixed while the recording medium is placed on the second image bearing means.

69. The image forming apparatus according to claim 67, wherein the first image is formed on a first surface of the first image bearing means and is transferred onto the second image bearing means and a polarity of the first image on the second image bearing means is reversed so that the first image and a second image formed on the first surface of the first image bearing means are transferred onto respective surfaces of the recording medium approximately at a same time.

70. The image forming apparatus according to claim 67, wherein a plurality of images are transferred onto the second image bearing means, and the plurality of images are transferred one after another onto a plurality of successively conveyed recording mediums.

71. The image forming apparatus according to claim 67, wherein the image forming condition is controlled differently when the length of the recording medium exceeds the circumferential length of the second image bearing means.

72. The image forming apparatus according to claim 71, further comprising a plurality of sheet feeding means, wherein at least one selected of the plurality of sheet feeding means feeds a recording medium longer than the circumferential length of the second image bearing means.

73. The image forming apparatus according to claim 72, wherein the at least one selected sheet feeding means includes a long recording medium holder containing a sheet-like recording medium that is longer than the circumferential length of the second image bearing means.

74. The image forming apparatus according to claim 73, wherein the at least one selected sheet feeding means includes a rolled sheet feeding device that contains and feeds a rolled recording medium.

75. The image forming apparatus according to claim 74, wherein one of the long recording medium holder and the rolled sheet feeding device is attachable and detachable to a main body of the image forming apparatus.

76. The image forming apparatus according to claim 67, wherein the controlled image forming condition includes a transfer condition.

77. The image forming apparatus according to claim 76, wherein an image transfer onto both-surfaces of the recording medium is prohibited when the recording medium is longer than the circumferential length of the second image bearing means.

78. The image forming apparatus according to claim 76, wherein an image transfer onto the second image bearing means from the first image bearing means is prohibited when the recording medium is longer than the circumferential length of the second image bearing means.

79. The image forming apparatus according to claim 67, wherein the controlled image forming condition includes a fixing condition.

80. The image forming apparatus according to claim 79, wherein a fixing temperature is increased compared to a fixing temperature set for a normal recording medium when the recording medium is longer than the circumferential length of the second image bearing means.

81. The image forming apparatus according to claim 67, wherein the second image bearing means is formed as an endless belt and is extended close to a fixing region.

82. The image forming apparatus according to claim 67, further comprising a long recording medium exit tray.

83. The image forming apparatus according to claim 82, wherein the long recording medium exit tray is provided below an exit tray for a normal recording medium.

84. The image forming apparatus according to claim 83, wherein a part of the long recording medium exit tray is contained in a main body of the image forming apparatus.

85. The image forming apparatus according to claim 82, wherein a part of the long recording medium exit tray is contained in a main body of the image forming apparatus.

86. The image forming apparatus according to claim 82, wherein a sheet conveying path is switched such that a recording medium that is equal to or longer than a predetermined length is discharged to the long recording medium exit tray when an image is formed on the recording medium that is equal to or longer than the predetermined length.

87. The image forming apparatus according to claim 67, wherein a length of the recording medium, for which the image forming condition is controlled, is designated through an operation panel.

88. The image forming apparatus according to claim 67, wherein a length of the recording medium, for which the image forming condition is controlled, is designated through an external apparatus connected to the image forming apparatus.

* * * * *